US011467529B2

(12) United States Patent
Endo

(10) Patent No.: US 11,467,529 B2
(45) Date of Patent: Oct. 11, 2022

(54) CLEANING DEVICE INCLUDING CLEANING BLADE PRESSED BY A PLURALITY OF SPRINGS

(71) Applicant: CANON KABUSHIKI KAISHA, Tokyo (JP)

(72) Inventor: Atsushi Endo, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/402,446

(22) Filed: Aug. 13, 2021

(65) Prior Publication Data

US 2022/0082985 A1 Mar. 17, 2022

(30) Foreign Application Priority Data

Sep. 15, 2020 (JP) ..... JP2020-155023

(51) Int. Cl.
*G03G 21/00* (2006.01)

(52) U.S. Cl.
CPC ..... *G03G 21/0011* (2013.01)

(58) Field of Classification Search
CPC ..... G03G 21/0011; G03G 21/0029
USPC ..... 399/350, 351
See application file for complete search history.

(56) References Cited

U.S. PATENT DOCUMENTS

| | | | | |
|---|---|---|---|---|
| 8,131,199 | B2 * | 3/2012 | Watanabe | G03G 21/0029 399/350 |
| 9,031,490 | B2 | 5/2015 | Ogura | 399/350 |
| 9,037,028 | B2 | 5/2015 | Takei | 399/74 |
| 2013/0189010 | A1 | 7/2013 | Takei | 399/350 |
| 2013/0195529 | A1 | 8/2013 | Ogura | 399/350 |

FOREIGN PATENT DOCUMENTS

| | | |
|---|---|---|
| JP | 2001-228764 | 8/2001 |
| JP | 2013-152341 | 8/2013 |
| JP | 2013-174862 | 9/2013 |
| JP | 2015-114478 | 6/2015 |

* cited by examiner

*Primary Examiner* — William J Royer
(74) *Attorney, Agent, or Firm* — Venable LLP

(57) ABSTRACT

A cleaning device includes a cleaning blade, a supporting portion, a housing, and a blade pressing spring. The blade pressing spring includes a first coil portion formed of a single wire material and provided between the supporting portion and the housing so as to capable of being expanded and contracted, a second coil portion provided between the supporting portion and the housing so as to be capable of being expanded and contracted, and a connecting portion connecting the first coil portion and the second coil portion. The first coil portion and the second coil portion are disposed side by side with respect to a direction crossing a center axis direction of the first coil portion.

15 Claims, 17 Drawing Sheets

(a)

(b)

(a)

(b)

(a)

(b)

CLEANING DEVICE INCLUDING CLEANING BLADE PRESSED BY A PLURALITY OF SPRINGS

FIELD OF THE INVENTION AND RELATED ART

The present invention relates to a cleaning device for use with an image forming apparatus, such as a copying machine, a printer, a facsimile machine, or a multi-function machine having a plurality of functions of these machines, a printer or a facsimile machine, using an electrophotographic type or an electrostatic recording type, and relates to the image forming apparatus.

Conventionally, for example, in the image forming apparatus, such as the copying machine, using the electrophotographic type, a cleaning device is used for removing toner (residual toner) remaining on an image bearing member after transferring a toner image from the image bearing member such as a photosensitive drum which is a rotatable member onto a transfer-receiving member. The cleaning device of a type in which the residual toner is scraped off from a surface of the rotating image bearing member by bringing a cleaning blade formed of an elastic member such as a rubber into contact with a surface (outer peripheral surface) of the image bearing member goes mainstream.

A supporting type of the cleaning blade is divided into a fixing supporting type and a swing supporting type. The fixing supporting type is as follows. To a supporting member formed of a metal plate or the like, the cleaning blade is fixed by bonding or the like, and the supporting member is fixed to a housing with screws, and then the cleaning blade is contacted to the image bearing member in a state in which the cleaning blade is bitten into (caused to enter) the image bearing member in a predetermined amount. The swing supporting type is as follows. Similarly as described above, the cleaning blade is fixed to the supporting member, and the supporting member is swingably supported by the housing and then is pressed by a pressing member such as a compression coil spring so that the cleaning blade is contacted to the image bearing member at a predetermined pressing force (pressure). Incidentally, the supporting member is swingably supported by the housing by providing a swing-supporting point through insertion of a swingable pin into a swing hole provided in the supporting member and a supporting hole provided in the housing.

Even in the case where the cleaning blade is abraded, the swing supporting type easily maintains stable contact pressure by swing of the cleaning blade while following abrasion thereof. For that reason, the swing supporting type may preferably be used in a cleaning device requiring a relatively long lifetime.

On the other hand, the fixing supporting type has a simple constitution such that the supporting member is fixed to the housing with the screws, whereas the swing supporting type needs that the swing pin and the pressing member are assembled with the housing. For that reason, a degree of difficulty of assembling increases when compared with the fixing supporting type.

In Japanese Laid-Open Patent Application 2001-228764, a constitution in which the neighborhood of a free end of a compression coil spring is supported by a supporting portion in a state in which a base portion of the compression coil spring pressing the cleaning blade is held by a casing has been proposed. By such a constitution, an attitude of the compression coil spring is stabilized by preventing falling of the compression coil spring during assembling, so that a pressing force of the cleaning blade against the image bearing member can be stabilized.

In order to suppress a variation in pressing force of the compression coil spring by the influence of a tolerance of various component parts, a constitution in which the compression coil spring pressing one end side of the blade is divided into a plurality of compression coil spring and in which the plurality of compression coil springs are disposed in parallel and are pressed would be considered. However, there is a liability that the number of component parts of the compression coil spring pressing the blade increases and thus an assembling property lowers.

SUMMARY OF THE INVENTION

A principal object of the present invention is to provide a cleaning device capable of suppressing an increase in number of component parts and a lowering in assembling property in a constitution in which a blade is pressed by a plurality of compression coil springs.

According to an aspect of the present invention, there is provided a cleaning device comprising: a cleaning blade configured to remove toner from a surface of a rotatable member in contact with the surface of the rotatable member; a supporting portion configured to support the cleaning blade; a housing configured to swingably hold the supporting portion; and a blade pressing spring provided between the supporting portion and the housing and configured to press the supporting portion so as to press the cleaning blade against the rotatable member, wherein the blade pressing spring includes: a first coil portion formed of a single wire material and provided between the supporting portion and the housing so as to be capable of being expanded and contracted; a second coil portion provided between the supporting portion and the housing so as to be capable of being expanded and contracted; and a connecting portion connecting the first coil portion and the second coil portion, and wherein the first coil portion and the second coil portion are disposed side by side with respect to a direction crossing a center axis direction of the first coil portion.

Further features of the present invention will become apparent from the following description of exemplary embodiments with reference to the attached drawings.

Figure 5:
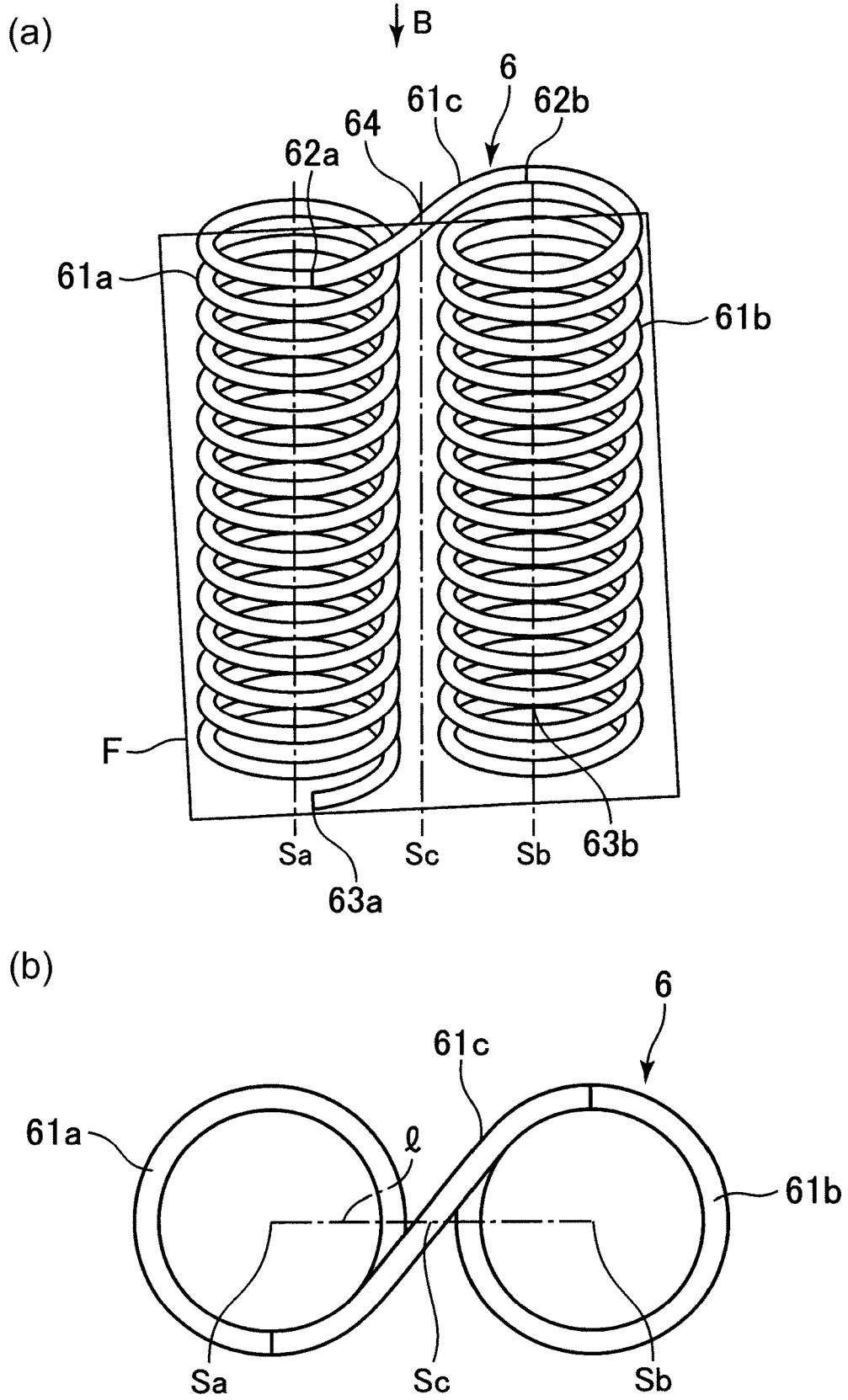

Parts (a) and (b) of FIG. 5 are a perspective view and a top view, respectively, of a blade pressing spring.

Figure 6:
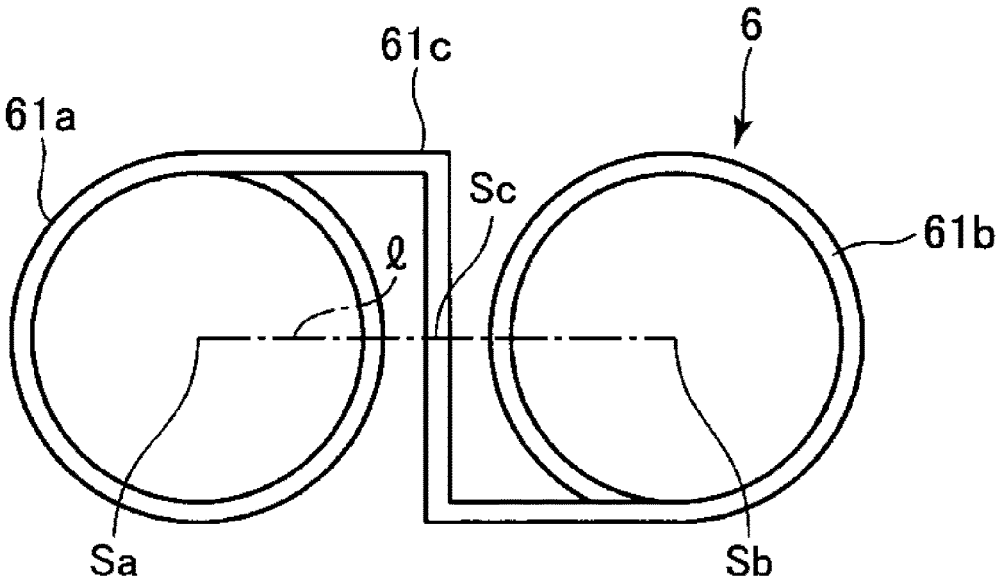

FIG. 6 is a top view of another example of the blade pressing spring.

Figure 7:
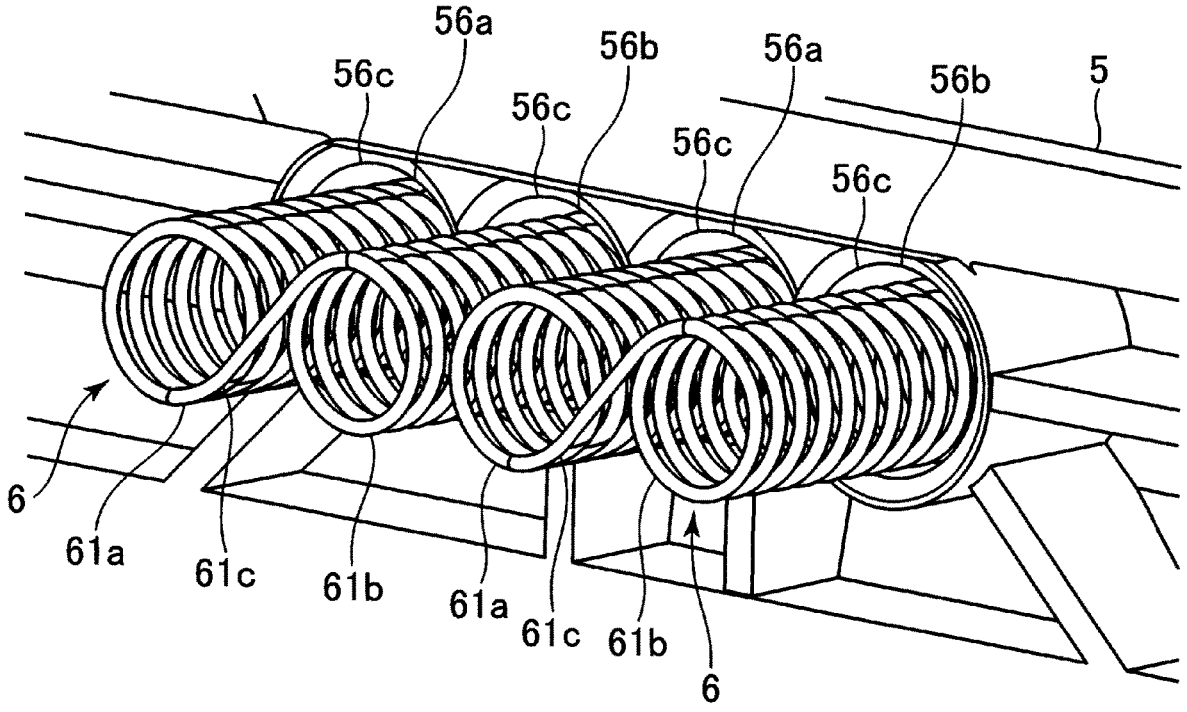

FIG. 7 is a perspective view of a mounting portion of the blade pressing spring.

Figure 8:
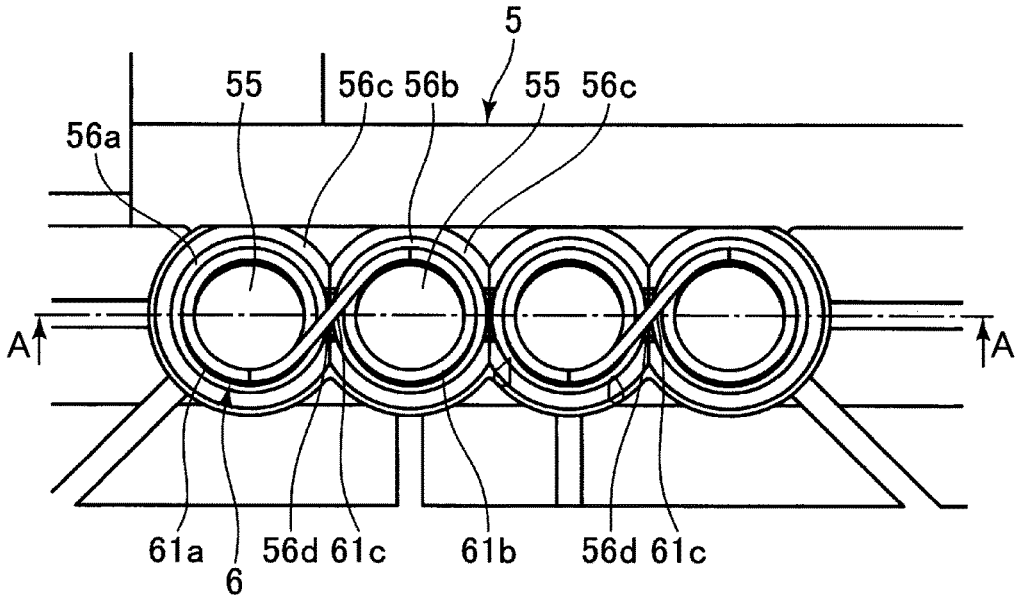
Figure 8:
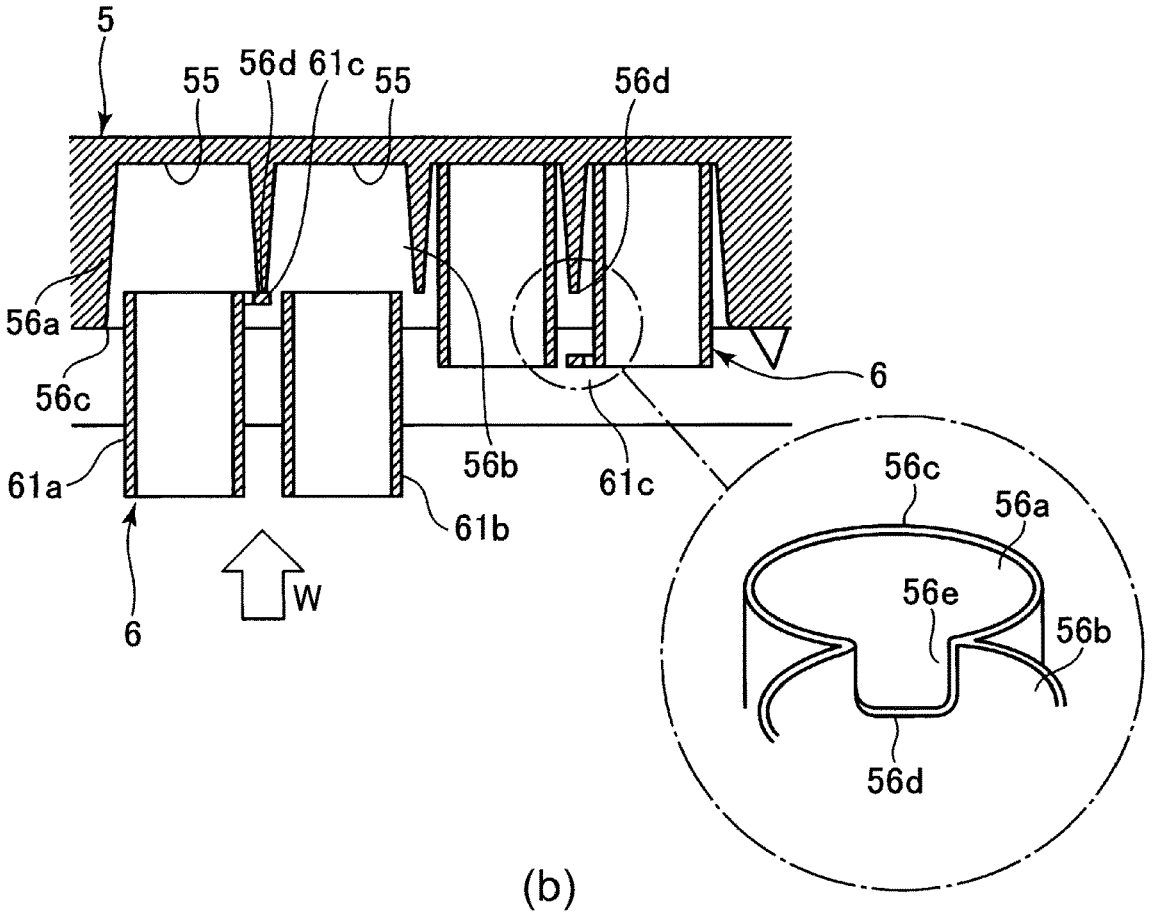

Parts (a) and (b) of FIG. 8 are a side view and a sectional view of the mounting portion of the blade pressing spring.

Figure 9:
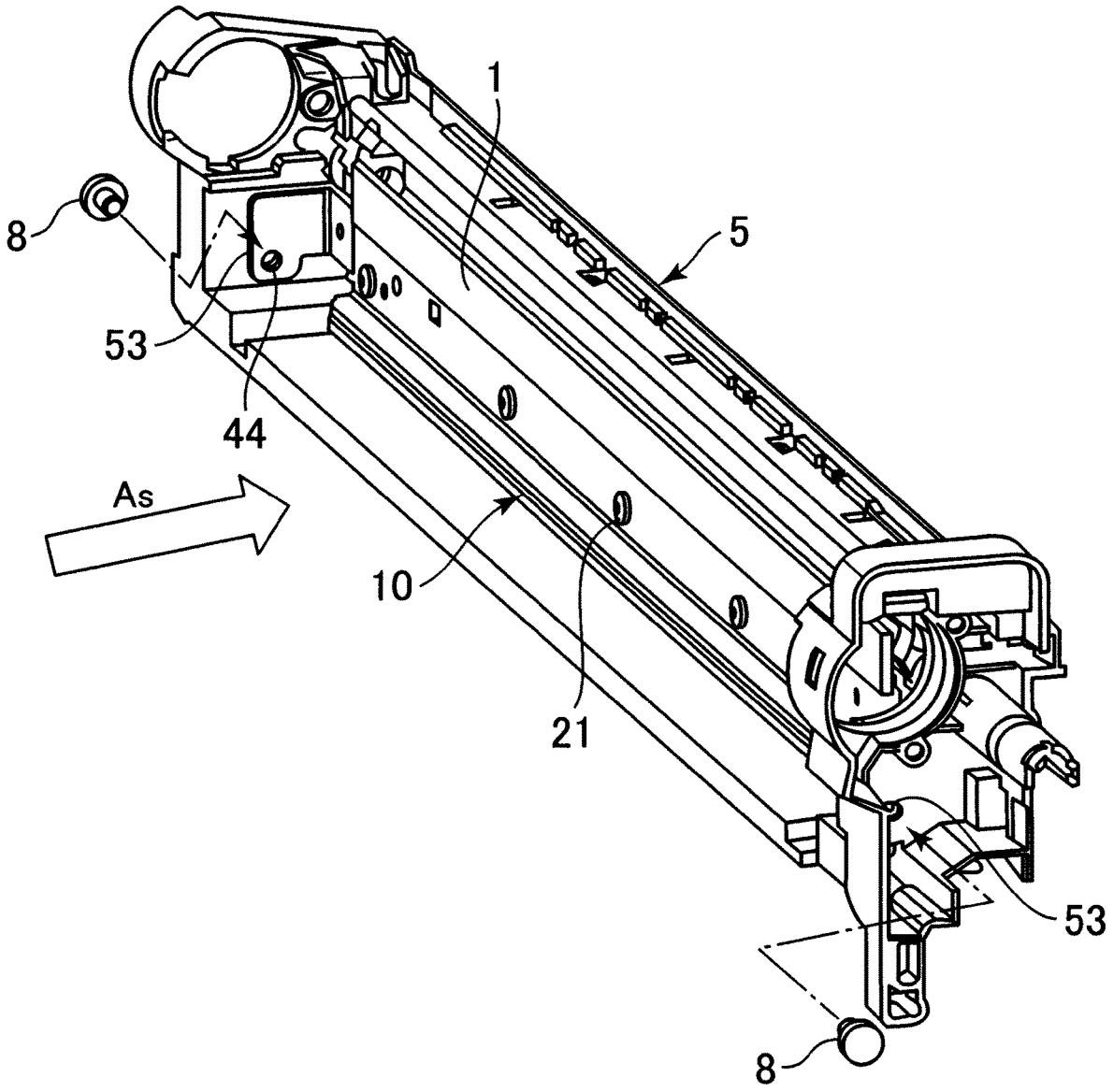

FIG. 9 is a perspective view showing an assembling method of a blade assembly.

Figure 10:
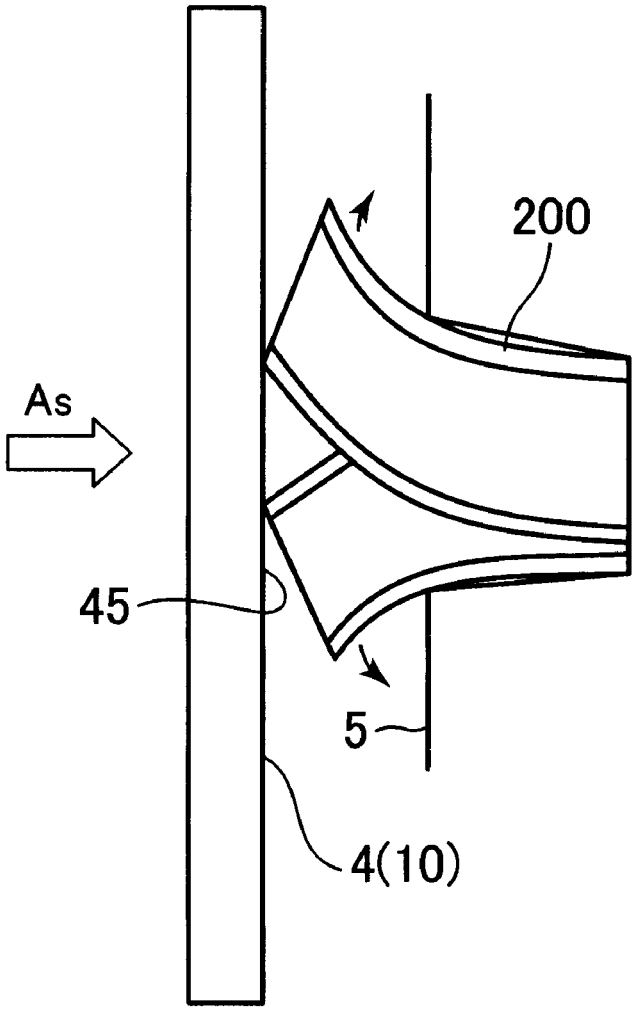

FIG. 10 is a sectional view for illustrating falling of a compression coil spring or the like.

Figure 11:
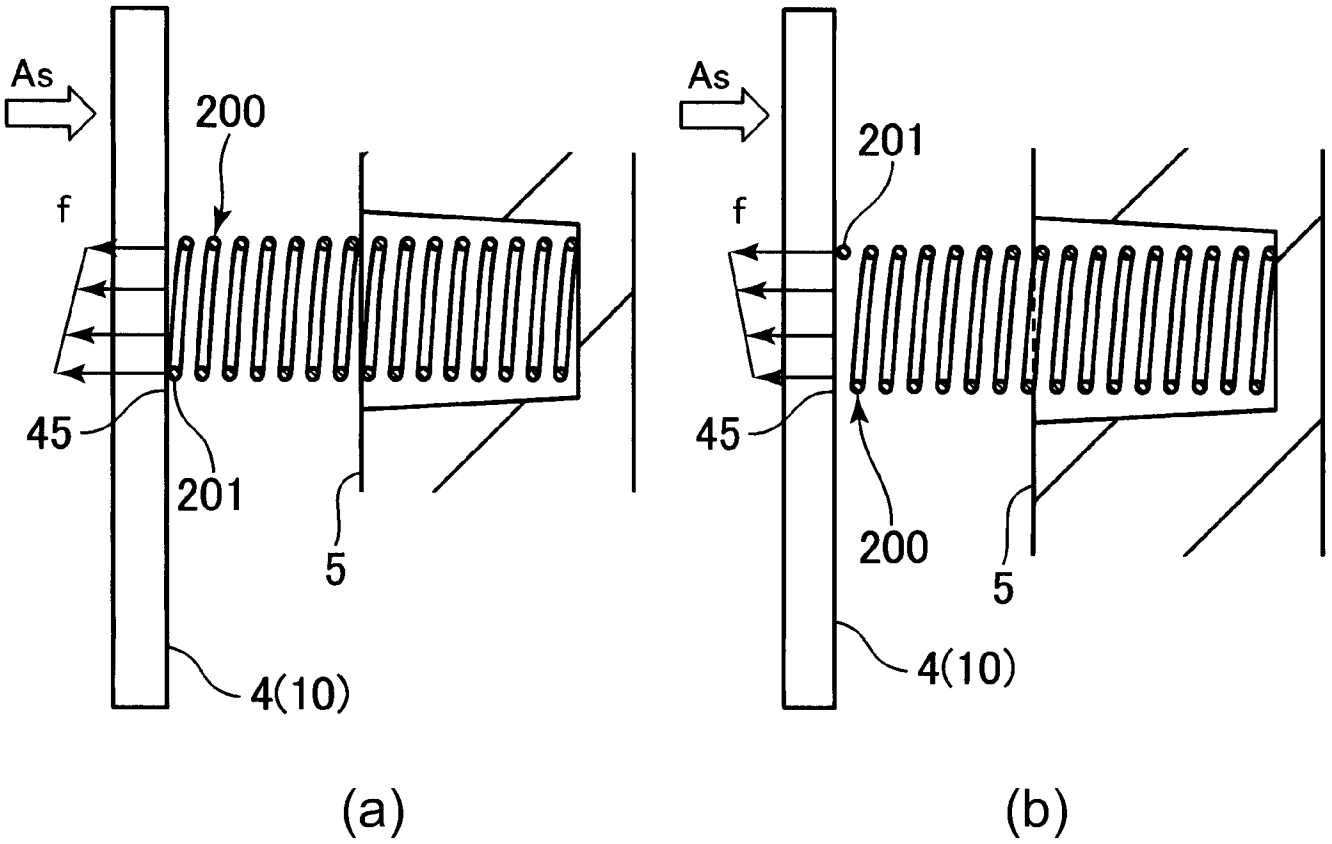

Parts (a) and (b) of FIG. 11 are sectional views for illustrating a fluctuation in distribution of a pressing force of a compression coil spring.

Figure 12:
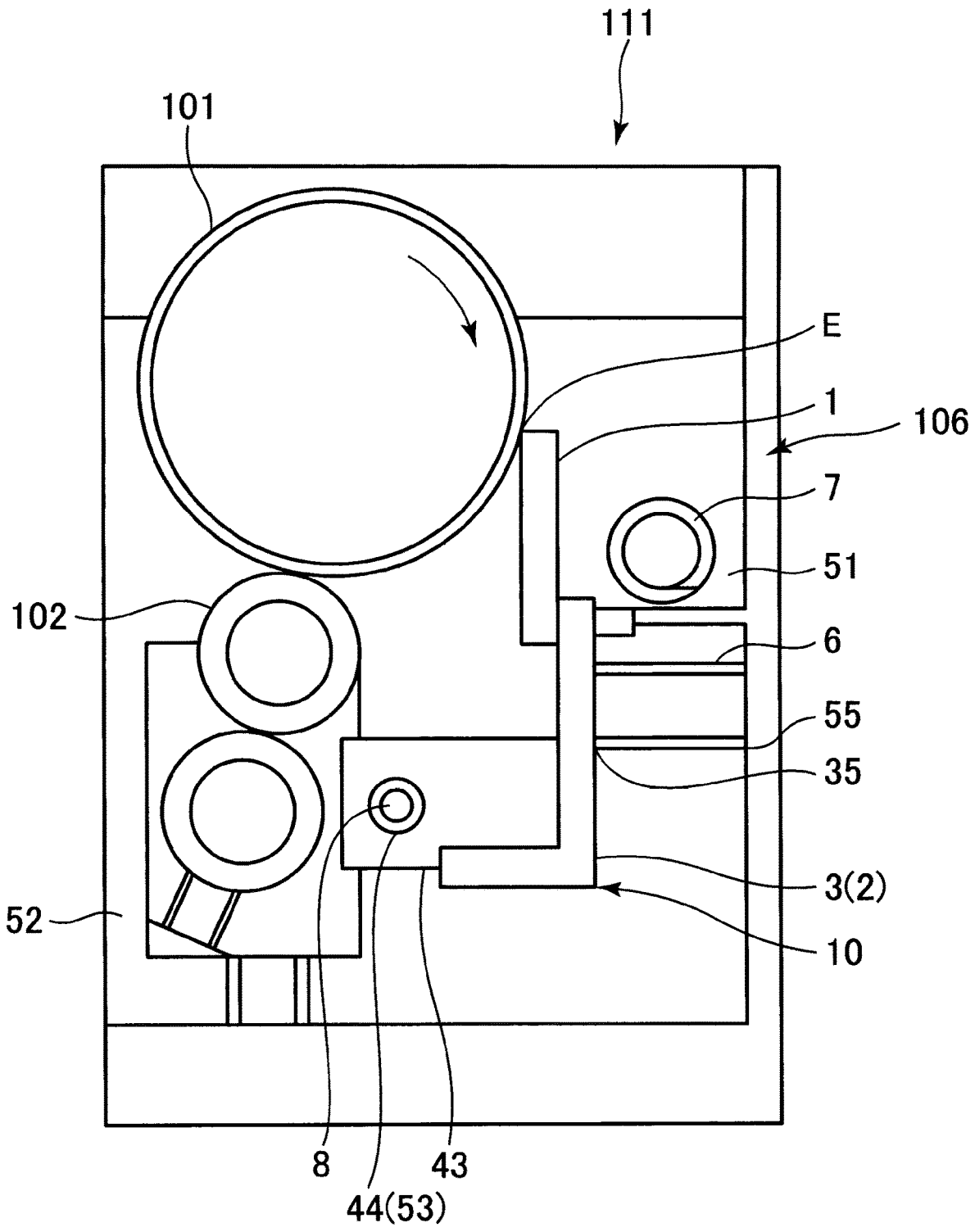

FIG. 12 is a schematic sectional view of a drum cartridge showing another example of a supporting member.

Figure 13:
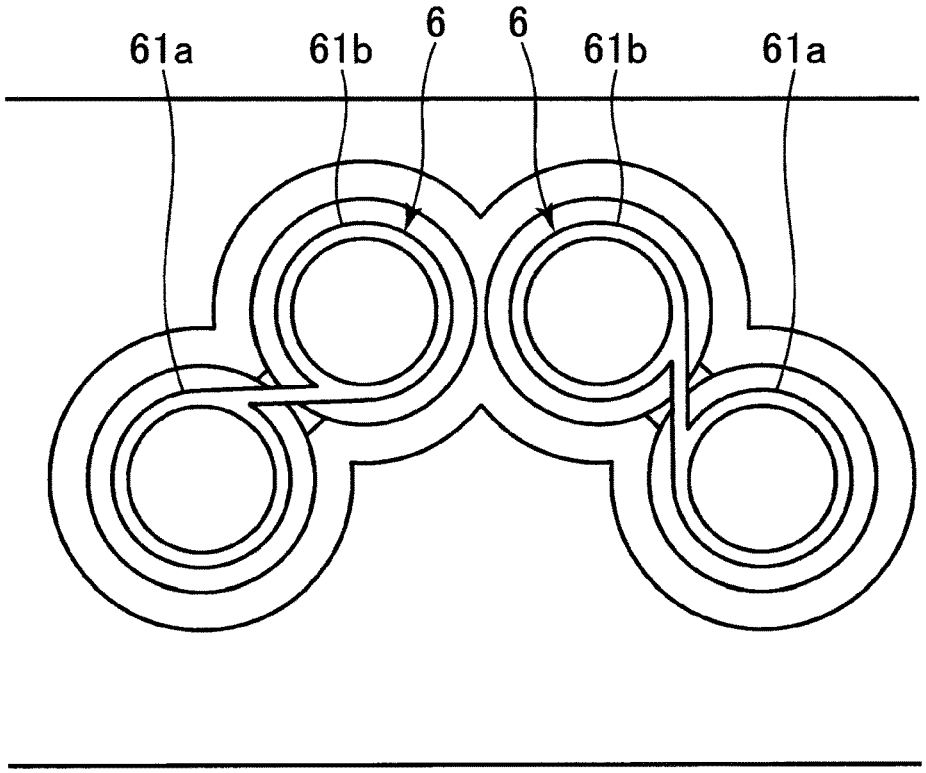

FIG. 13 is a side view showing another example of an arrangement of the blade pressing spring.

Figure 14:
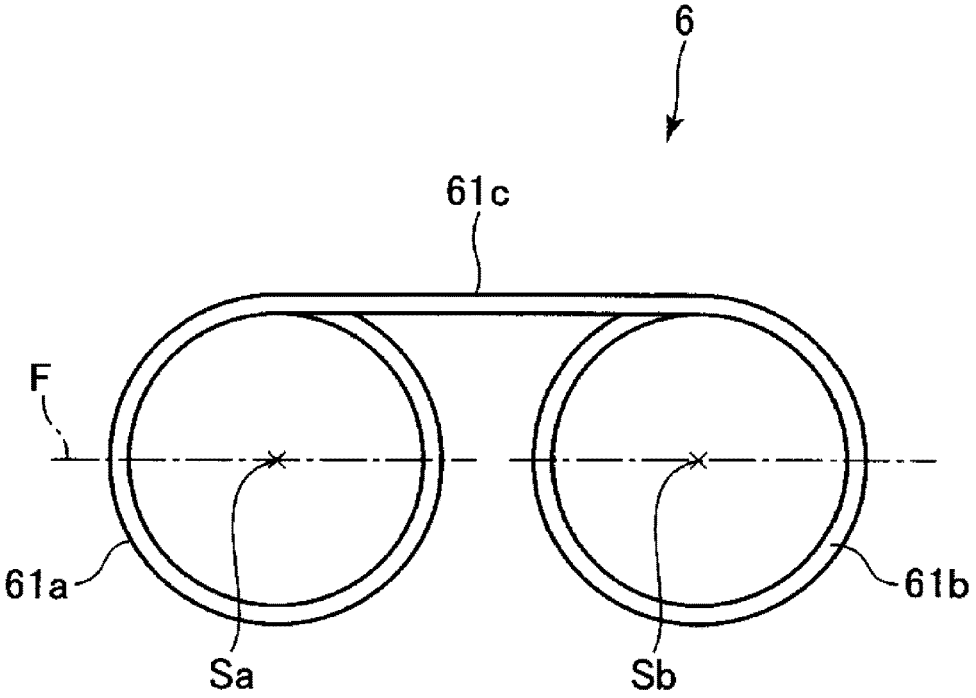

FIG. 14 is a top view showing another example of the blade pressing spring.

Figure 15:
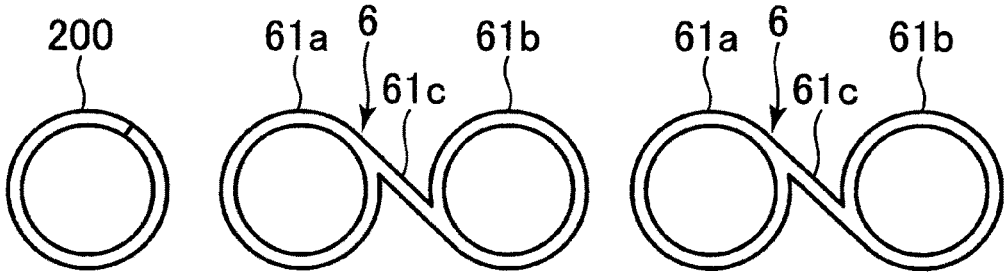
Figure 15:
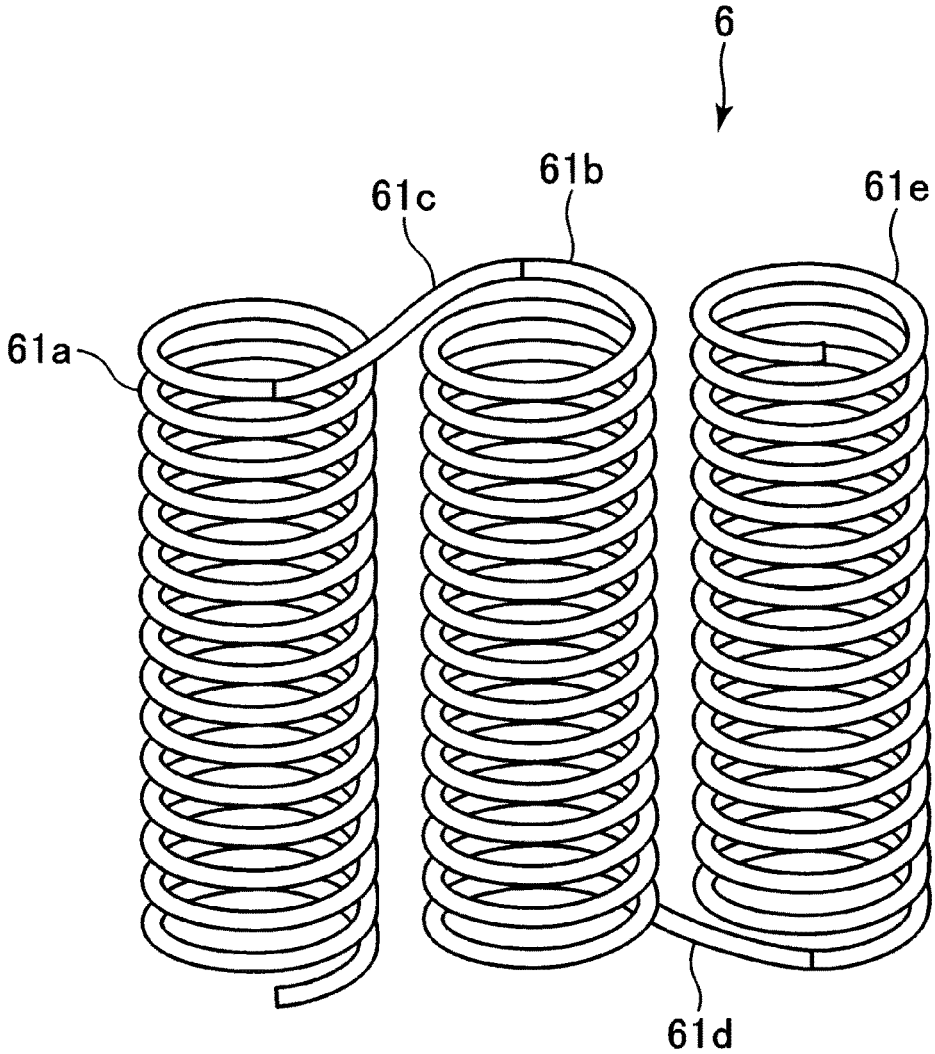

Parts (a) and (b) of FIG. 15 are schematic views each for illustrating another example of the blade pressing spring.

Figure 16:
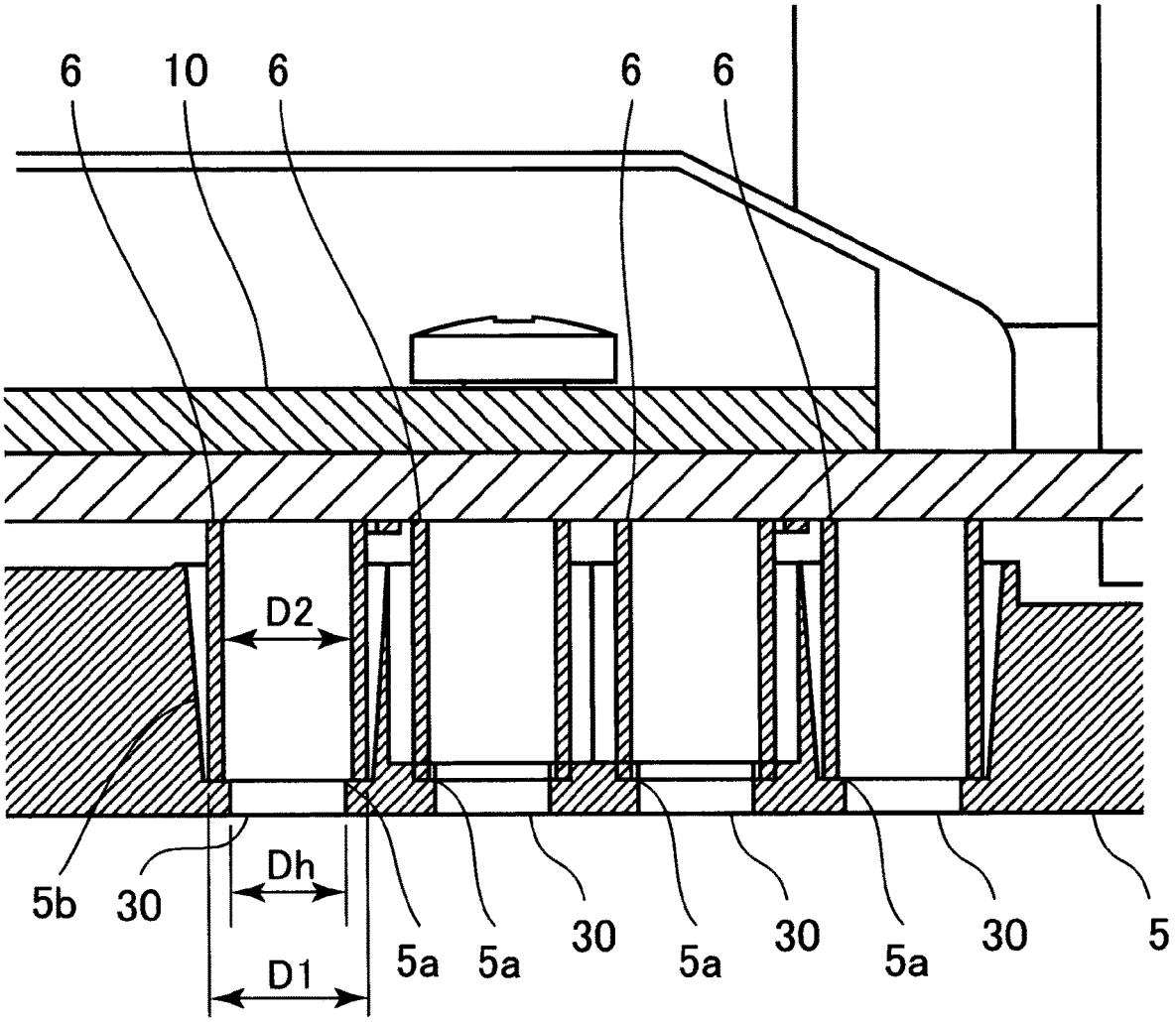

FIG. 16 is a sectional view for illustrating through holes of a housing.

Figure 17:
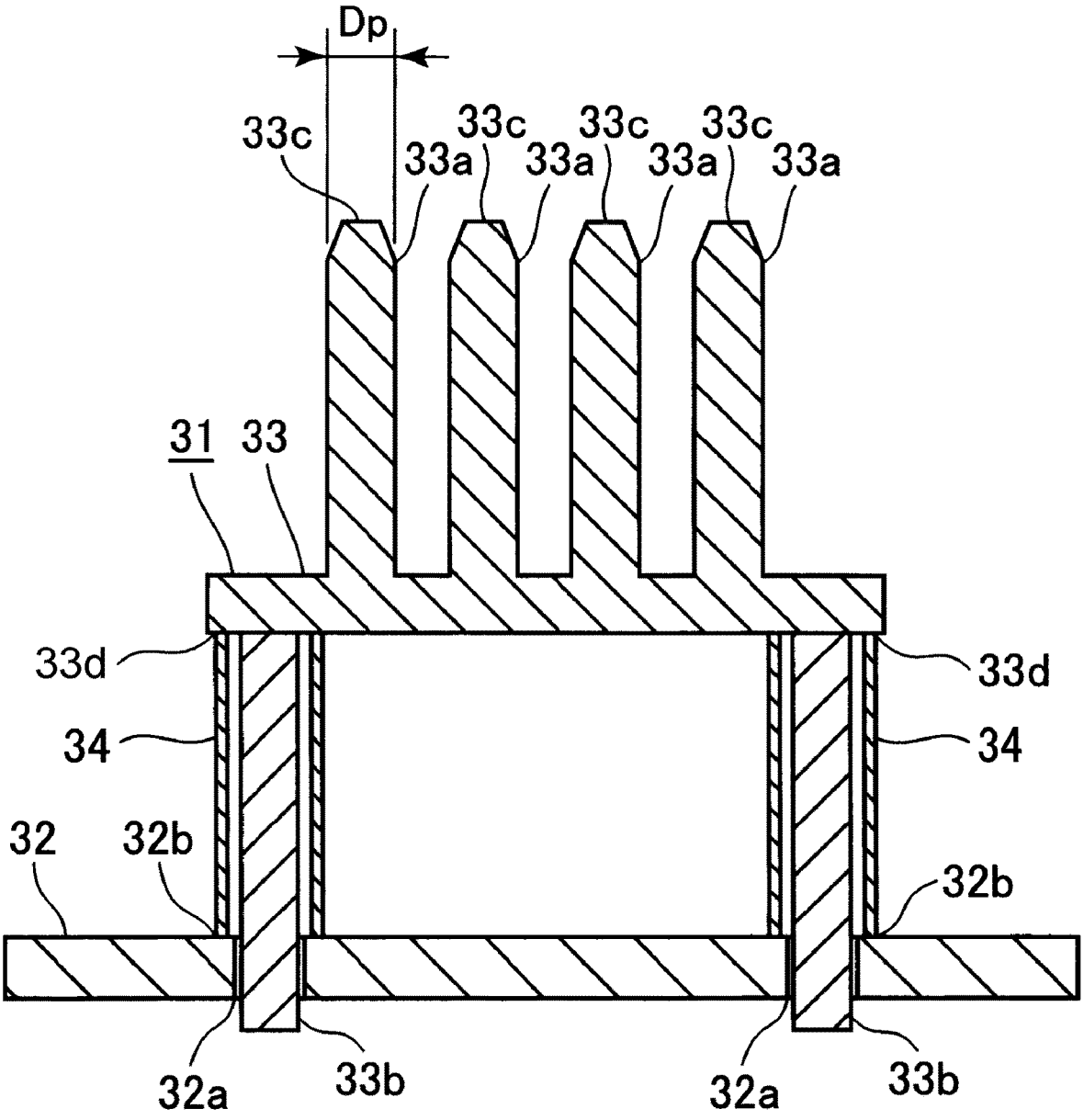

FIG. 17 is a sectional view showing an assembling tool of the blade assembly.

Figure 18:
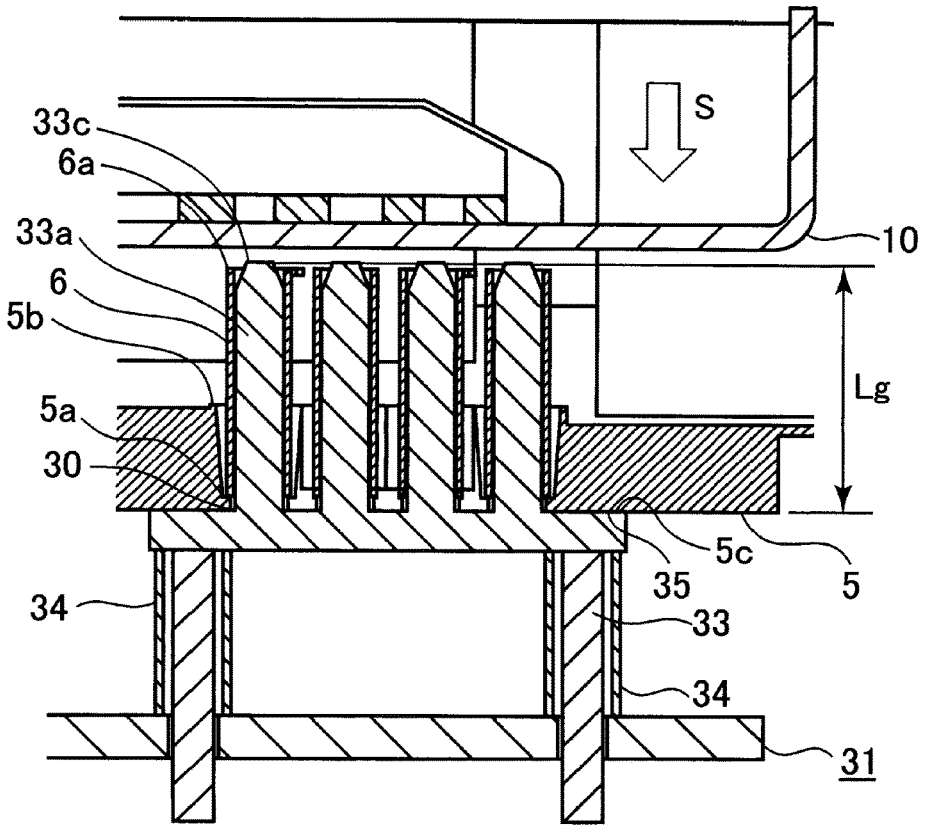
Figure 18:
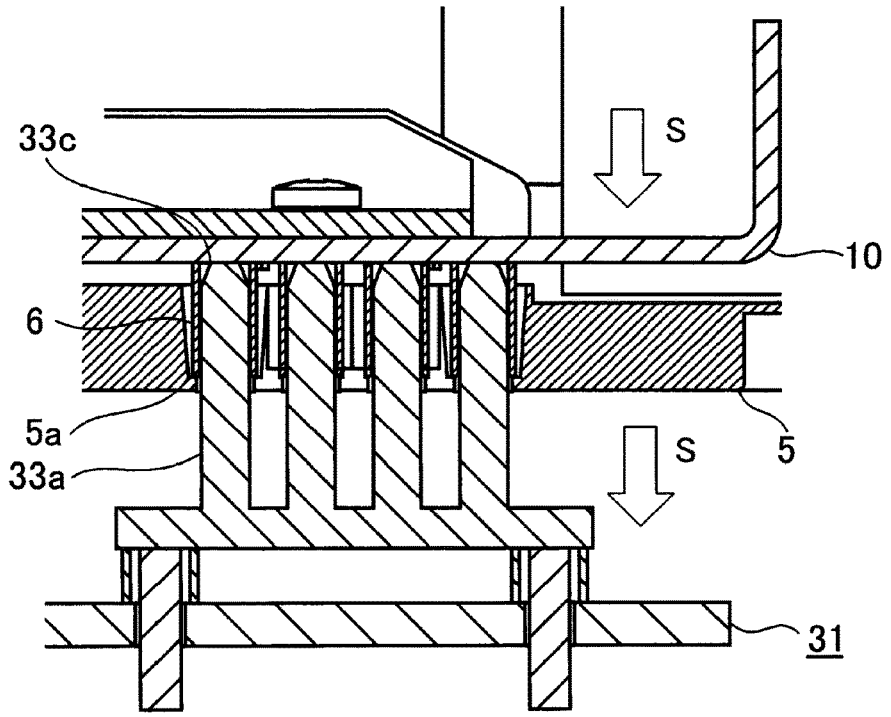

Parts (a) and (b) of FIG. 18 are sectional views for illustrating an assembling procedure using the assembling tool.

Figure 19:
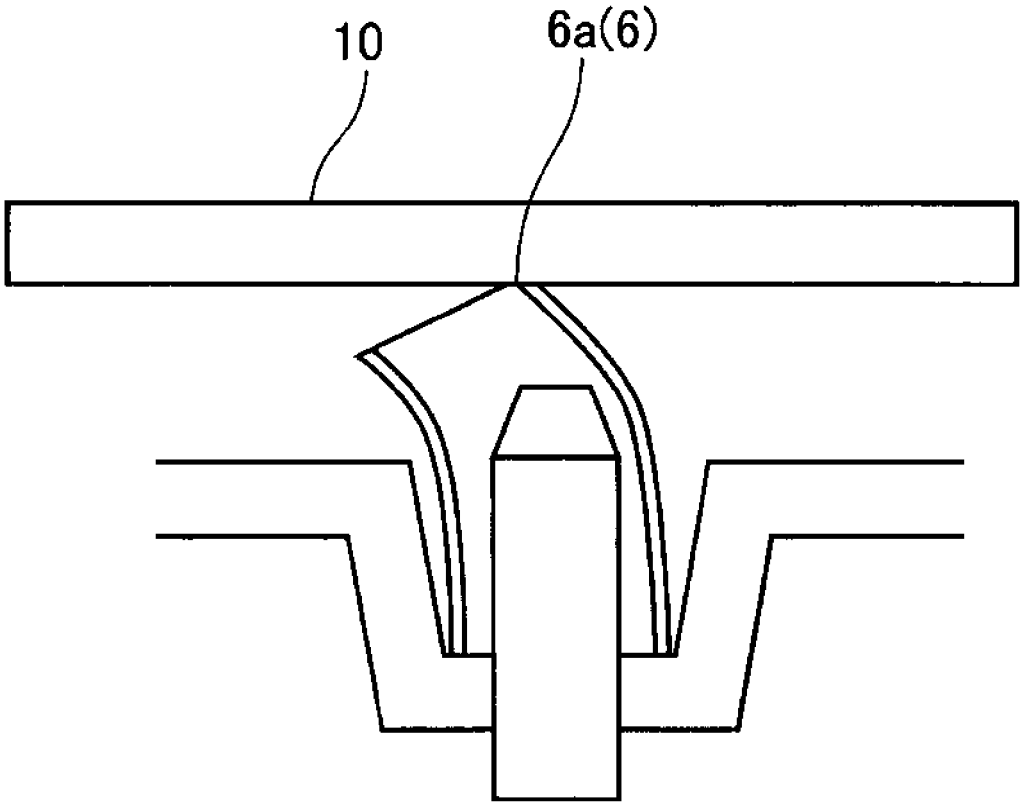

FIG. 19 is a sectional view for illustrating falling of a blade pressing spring or the like.

DESCRIPTION OF EMBODIMENTS

A cleaning device according to the present invention and an image forming apparatus will be described specifically with reference to the drawings.

Embodiment 1

1. Constitution and Operation of Image Forming Apparatus

Figure 1:
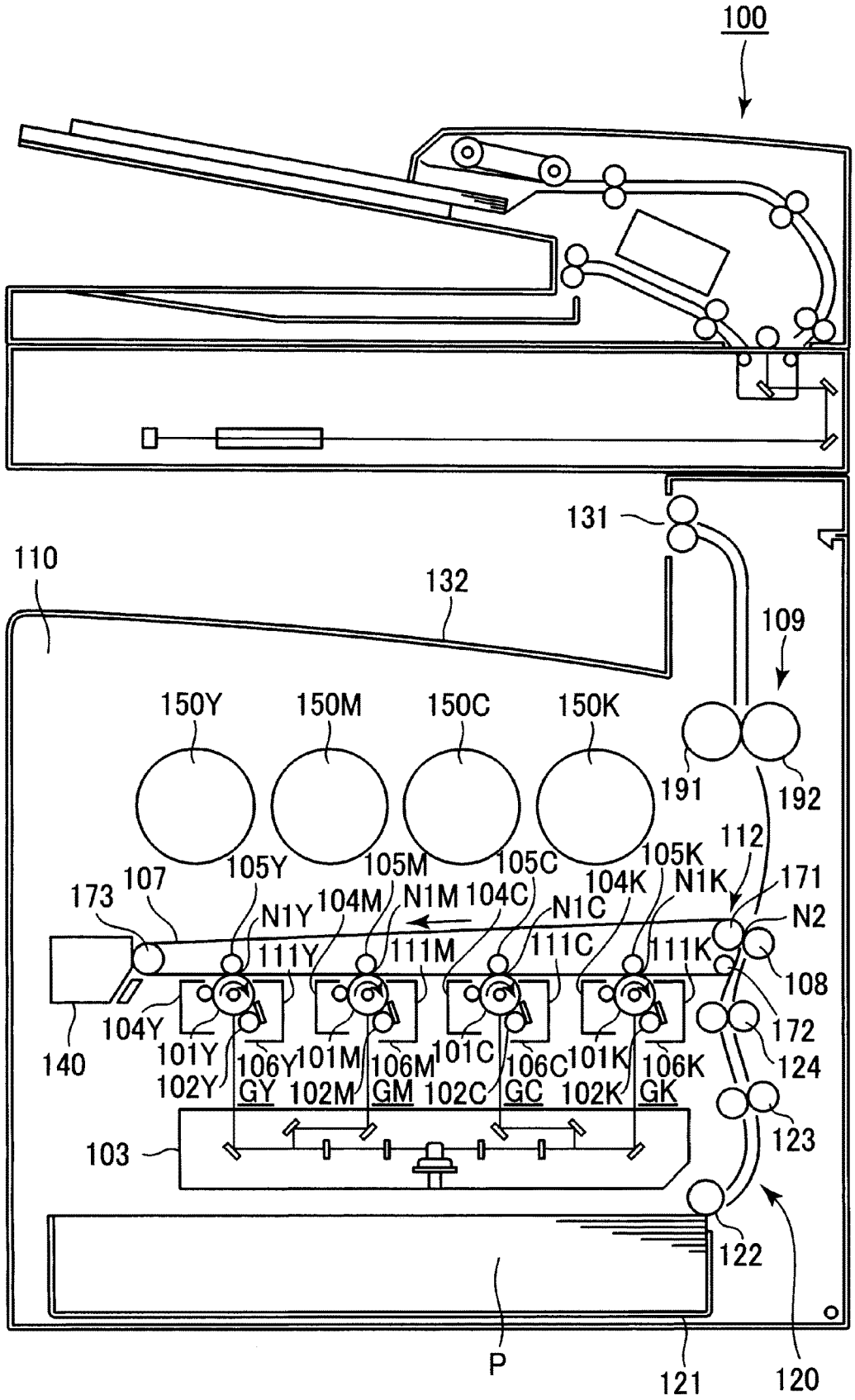
FIG. 1 is a schematic sectional view of an image forming apparatus.

FIG. 1 is a schematic sectional view of an image forming apparatus 100 according to an embodiment of the present invention. The image forming apparatus 100 of this embodiment is a tandem-type image forming apparatus (full-color laser beam printer) which is capable of forming a full-color image using an electrophotographic type and which employs an intermediary transfer type.

The image forming apparatus 100 includes, as a plurality of image forming portions (stations), first to fourth image forming portions GY, GM, GC and GK for forming toner images of yellow (Y), magenta (M), cyan (C) and black (K), respectively. In the first to fourth image forming portions GY, GM, GC and GK, as regards elements having the same or corresponding functions or constitutions, suffixes Y, M, C and K for representing elements for associated colors are omitted, and the elements will be collectively described in some instances. In this embodiment, the image forming portion G is constituted by including a photosensitive drum 101, a charging roller 102, an exposure device 103, a developing device 104, a primary transfer roller 105 and a drum cleaning device 106, which are described later.

The photosensitive drum 101 which is a drum-shaped (cylindrical) electrophotographic photosensitive member as a first image bearing member is rotationally driven in the clockwise direction in FIG. 1 at a predetermined peripheral speed (process speed). The photosensitive drum 101 is an example of a rotatable member constituting a cleaning object of a cleaning device in this embodiment. In this embodiment, the photosensitive drum 101 is prepared by forming a photosensitive layer having a negative charge polarity on an outer peripheral surface of a cylindrical aluminum cylinder. To the photosensitive drum 101, a driving force is transmitted from a driving motor (not shown) constituting a driving means provided in an apparatus main assembly 110 of the image forming apparatus 100. A surface of the rotating photosensitive drum 101 is electrically charged uniformly to a predetermined polarity (negative in this embodiment) and to a predetermined potential by the charging roller 102 which is a roller-shaped charging member. The charging roller 102 is contacted to the surface of the photosensitive drum 101 by being pressed with a predetermined pressing force to the surface of the photosensitive drum 101 and is rotated by rotation of the photosensitive drum 101. During the charging, to the charging roller 102, a predetermined charging voltage (charging bias) is applied from a charging voltage source (not shown) which is a high-voltage source. The charged surface of the photosensitive drum 101 is subjected to scanning exposure to light depending on image information by the exposure device (laser scanner device) 103 as an exposure means (electrostatic latent image forming means) so that an electrostatic latent image (electrostatic image) is formed on the photosensitive drum 101. The exposure device 103 writes (forms) the electrostatic latent image depending on the image information on the surface of the photosensitive drum 101 by irradiating the surface of the photosensitive drum 101 with a laser beam by scanning through a rotating mirror. In this embodiment, the exposure device 103 is constituted as a single unit capable of exposing the photosensitive drums 101Y, 101M, 101C, and 101K to light. The electrostatic latent image formed on the photosensitive drum 101 is developed (visualized) with toner as a developer supplied by the developing device 104 as a developing means, so that a toner image is formed on the photosensitive drum 101. The developing device 104 uses, a two-component developer including toner (non-magnetic toner particles) and a carrier (magnetic carrier particles), and develops the electrostatic latent image by depositing the toner on the electrostatic latent image formed on the photosensitive drum 101. During development, to a developing sleeve as a developer carrying member provided in the developing device 104, a predetermined developing voltage (developing bias) is applied from a developing voltage source which is a high-voltage source. Further, in this embodiment, on an exposure portion (image portion) on the photosensitive drum 101 lowered in absolute value of the potential through exposure after being uniformly charged, toner charged to the same charge polarity of the photosensitive drum 101 is deposited (reverse development). In this embodiment, a normal charge polarity of the toner which is the toner charge polarity during development is negative. To the developing device 104, the toner is supplied from a toner bottle 150 as a toner container through a toner feeding passage (not shown).

As a second image bearing member, an intermediary transfer belt 107 which is an intermediary transfer member constituted by an endless belt is provided so as to oppose the respective photosensitive drums 101 of the respective image forming portions G. The intermediary transfer belt 107 is extended and stretched under application of a predetermined tension by, as a plurality of stretching rollers (supporting rollers), a pre-secondary transfer opposite roller 171, a pre-secondary transfer roller 172 and a tension roller 173. The intermediary transfer belt 107 is formed in an endless shape by a dielectric resin such as polyimide. The intermediary transfer belt 107 is rotated (moved and circulated) in the counterclockwise direction in FIG. 1 by rotational drive of the pre-secondary transfer opposite roller 171 having a function of a driving roller at a peripheral speed (process speed) substantially equal to the peripheral speed of the photosensitive drum 101. To the pre-secondary transfer opposite roller 171, a driving force is transmitted from a belt driving motor (not shown) constituting a driving means provided in the apparatus main assembly 110. In the inner peripheral surface side of the intermediary transfer belt 107, correspondingly to the respective photosensitive drums 101, primary transfer rollers 105 which are roller-shaped primary transfer members as primary transfer means are provided.

Each of the primary transfer rollers 105 is urged (pressed) against an inner peripheral surface of the intermediary transfer belt 107 toward the associated photosensitive drum 101, so that a primary transfer portion (primary transfer nip) N1 where the intermediary transfer belt 107 and the photosensitive drum 101 contact each other is formed. The stretching rollers other than the pre-secondary transfer opposite roller 171 and the respective primary transfer roller 105 are rotated with rotation of the intermediary transfer belt 107. The toner image formed on the photosensitive drum 101 is transferred (primary-transferred) at the primary transfer portion N1 onto the rotating intermediary transfer belt 107 by the action of the primary transfer roller 105. During a primary transfer step, to the primary transfer roller 105, a primary transfer voltage (primary transfer bias) which is a DC voltage of an oppose polarity (positive in this embodiment) to the normal charge polarity of the toner is applied from a primary transfer voltage source which is a high-voltage source (not shown). For example, during full-color image formation, the toner images, of the respective colors of yellow, magenta, cyan and black, formed on the respective photosensitive drums 101 are successively transferred superposedly onto the intermediary transfer belt 107.

In the outer peripheral surface side of the intermediary transfer belt 107, at a position opposing the pre-secondary transfer opposite roller 171 also functioning as a secondary transfer opposite roller, a secondary transfer roller 108 which is a roller-shaped secondary transfer member as a secondary transfer means is provided. The secondary transfer roller 108 is urged (pressed) toward the pre-secondary transfer opposite roller 171 and is contacted to the secondary transfer opposite roller 171 via the intermediary transfer belt 107, so that a secondary transfer portion (secondary transfer nip) N2 where the intermediary transfer belt 107 and the secondary transfer roller 108 contact each other is formed. The toner images formed on the intermediary transfer belt 107 are transferred (secondary-transferred), at the secondary transfer portion N2, onto a recording material P such as paper nipped and fed by the intermediary transfer belt 107 and the secondary transfer roller 108, by the action of the secondary transfer roller 108. During secondary transfer, to the secondary transfer roller 108, a secondary transfer voltage (secondary transfer bias) which is a DC voltage of the opposite polarity to the normal charge polarity of the toner is applied from a secondary transfer voltage source which is a high-voltage source (not shown). The recording materials (transfer materials, recording media, forms, sheets) P are accommodated in a recording material cassette 121 as a recording material accommodating portion. The recording materials P are fed one by one from the recording material cassette 121 by a feeding roller 122 and the like, and is conveyed to a registration roller pair 124 as a feeding member by a conveying roller pair 123 as a conveying member. This recording material P is subjected to correction of oblique movement by the registration roller pair 124 and is conveyed to the secondary transfer portion N2 by being timed to the toner images on the intermediary transfer belt 107. A feeding and conveying device 120 is constituted by the recording material cassette 121, the feeding roller 122, the conveying roller pair 123, the registration roller pair 124 and the like.

The recording material P on which the toner images are transferred is conveyed to a fixing device 109 as a fixing means. The fixing device 109 heats and presses the recording material P, on which the unfixed toner images are carried, by a fixing roller 191 provided with a heat source and by a pressing roller 192 press-contacted to the fixing roller 191, so that the toner images are fixed (melted, stuck) on a surface of the recording material P. The recording material P on which the toner images are fixed is discharged (outputted) to a discharge tray 132 as a discharge portion by a discharging roller pair 131 and the like as a discharging member.

On the other hand, toner (primary transfer residual toner) remaining on the photosensitive drum 101 after the primary transfer step is removed and collected from the photosensitive drum 101 by a cleaning device (drum cleaning device) 106 as a cleaning means (photosensitive member cleaning means) 106. Further, in the outer peripheral surface side of the intermediary transfer belt 107, at a position opposing the tension roller 173, a belt cleaning device 140 as an intermediary transfer member cleaning means is provided. That is, the belt cleaning device 140 is disposed downstream of the secondary transfer portion N2 and upstream of the primary transfer portion N1 (most upstream primary transfer portion N1Y) with respect to a surface movement direction of the intermediary transfer belt 107. A deposited matter such as toner (secondary transfer residual toner) or paper powder remaining on the intermediary transfer belt 107 after the secondary transfer is removed and collected from the intermediary transfer belt 107 by the belt cleaning device 140. In this embodiment, as described later, the cleaning device 106 includes a cleaning blade, formed of an elastic rubber material, as a cleaning member, and an edge portion of a free end portion of the cleaning blade is contacted to the surface of the photosensitive drum 101 at a predetermined pressing force. Then, the cleaning device 106 scrapes off and collects the primary transfer residual toner from the surface of the rotating photosensitive drum 101 by the cleaning blade. Similarly, in this embodiment, the belt cleaning device 140 includes a cleaning blade, formed of an elastic rubber material, as a cleaning member, and an edge portion of a free end portion of the cleaning blade is contacted to the surface of the intermediary transfer belt 107 at a predetermined pressing force. Further, the belt cleaning device 140 scrapes off and collects the secondary transfer residual toner from the surface of the intermediary transfer belt 107 by the cleaning blade. Collected matters such as the residual toners collected by the cleaning device 106 and the belt cleaning device 140 are conveyed and collected into a residual toner collecting container (not shown) via a residual toner conveying portion (not shown). The residual toner collecting container is exchanged to a blank residual toner collecting container, for example, in the case where the container becomes full or in the like case.

In this embodiment, at each of the image forming portions G, the photosensitive drum 101, the charging roller 102, a cleaning roller (unnumbered) and the cleaning device 106 integrally constitute a drum cartridge 111 (process cartridge) detachably mountable to the apparatus main assembly 110. Further, in this embodiment, in each of the image forming portion G, the developing device 104 is detachably mountable to the apparatus main assembly 110 substantially alone. Incidentally, the cleaning device 106 may also be detachably mountable to the apparatus main assembly 110 integrally with at least one of the photosensitive member, the charging means, and the developing means. Further, in this embodiment, the intermediary transfer belt 107, the stretching rollers 171 to 173, the primary transfer rollers 105, and the belt cleaning device 140 integrally constitute an intermediary transfer unit 112 detachably mountable to the apparatus main assembly 110.

2. Drum Cartridge

Figure 2:
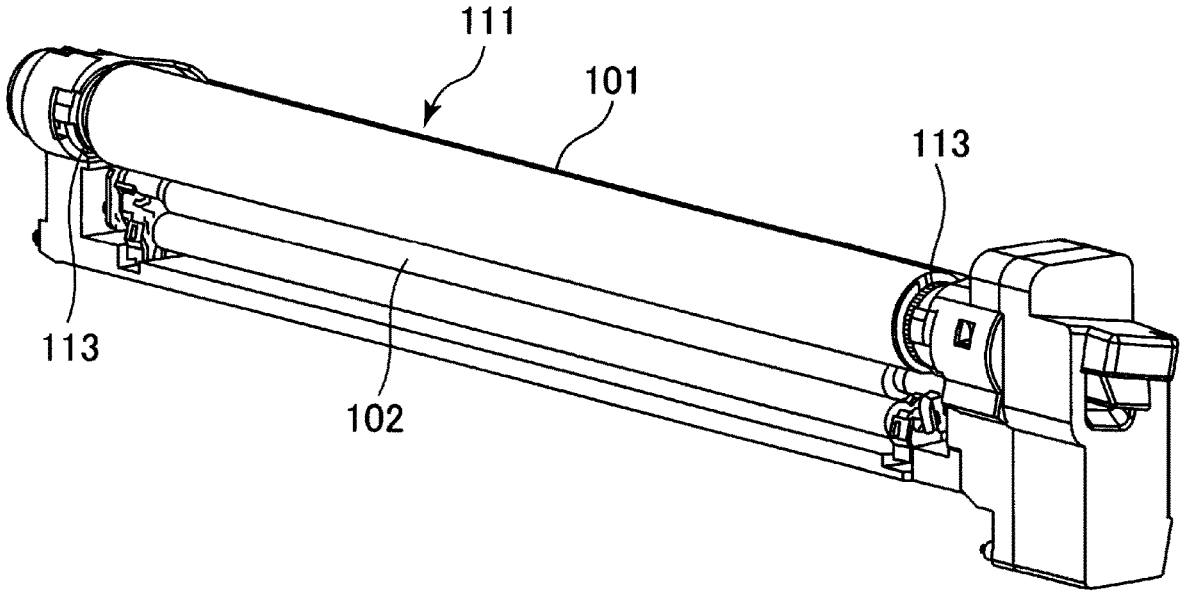
FIG. 2 is a schematic perspective view of an outer appearance of a drum cartridge.
Figure 3:
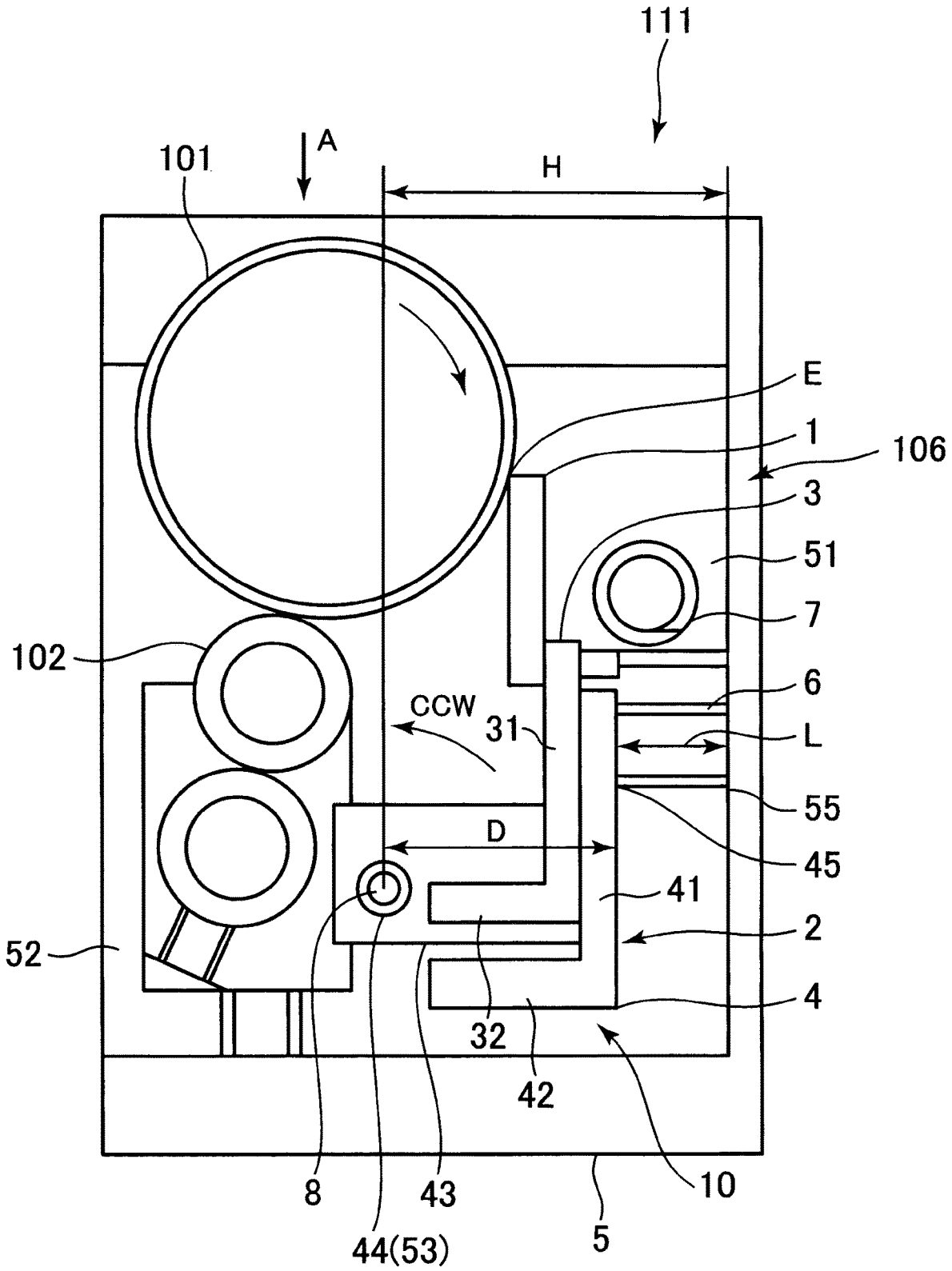
FIG. 3 is a schematic sectional view of the drum cartridge.

FIG. 2 is a schematic perspective view of an outer appearance of the drum cartridge 111. FIG. 3 is a schematic sectional view (cross section substantially perpendicular to a rotational axis direction of the photosensitive drum 101) of the drum cartridge 111 in this embodiment. Here, as regards the image forming apparatus 100 and elements thereof, a front side on the drawing sheet of FIG. 1 is referred to as a "front side", and a rear side of the drawing sheet is referred to as a "rear side". A front-rear direction connecting the front side and the rear side is substantially parallel to the rotational axis direction of the photosensitive drum 101. Further, as regards the drum cartridge 111 and elements (cleaning device 106 and elements thereof and the like) thereof, a direction substantially parallel to the rotational axis direction (substantially parallel to the above-described front-rear direction) of the photosensitive drum 101 is also referred simply to as a "longitudinal direction". Further, as regards the image forming apparatus 100 and the elements thereof, an up-down direction refers to the up-down direction with respect to a direction of gravitation (vertical direction), but the "up" and the "down" do not mean only "immediately above" and "immediately below", respectively, but include an "upper side" and a "lower side" with respect to a horizontal plane passing through a noted element or position.

The drum cartridge 111 is prepared by integrally holding the photosensitive drum 101, the charging roller 102, the cleaning device 106, and the like in a housing (case (casing), framework (frame), cleaning container) 5. Incidentally, the housing 5 may be constituted by a simple member or may also be constituted by connecting a plurality of members with an appropriate fixing means.

The drum cartridge 111 is constituted as a unit so as to be mountable in and dismountable from the apparatus main assembly 110. In this embodiment, the drum cartridge 111 is constituted so that the drum cartridge 111 is dismounted from the apparatus main assembly 110 by being slid toward the front side thereof along the longitudinal direction thereof and so that the drum cartridge 111 is mounted in the apparatus main assembly 110 by being slid toward the rear side. The drum cartridge 111 is mounted in and dismounted from the apparatus main assembly 110 for maintenance, exchange, or the like. Further, the exchange of the drum cartridge 111 is performed, for example, in the case where the photosensitive drum 101 reaches an end of a lifetime thereof, or the like case.

When the drum cartridge 111 is mounted in the apparatus main assembly 110, a cartridge-side coupling (not shown) provided on the drum cartridge 111 and a main assembly-side coupling (not shown) provided in the apparatus main assembly 110 are operatively connected to each other. The cartridge-side coupling is, for example, fixed to one end portion of the photosensitive drum 101 with respect to the rotational axis direction. By this, the photosensitive drum 101 is capable of being rotated by receiving a driving force from a driving motor (not shown) as a driving source provided in the apparatus main assembly 110. Further, when the drum cartridge 111 is mounted in the apparatus main assembly 110, a cartridge-side electrical contact portion (not shown) provided on the drum cartridge 111 and a main assembly-side electrical contact portion (not shown) provided in the apparatus main assembly 110 are electrically connected to each other. By this, a charging voltage can be applied to the charging roller 102.

The photosensitive drum 101 is rotatably supported by the housing 5 via a bearing member 113 at each of opposite end portions with respect to the rotational axis direction. The photosensitive drum 101 has a cylindrical shape, and a length thereof with respect to the rotational axis direction thereof is determined by a size of the recording material P and a size of the image, which are processed by the image forming apparatus 100. For example, in this embodiment, the image forming apparatus 100 processes the recording material P with a roughly A3 size, the length of the photosensitive drum 101 with respect to the rotational axis direction is about 400 mm. Further, the charging roller 102 is supported by the housing 5 via a bearing member (not shown) at each of the opposite end portions with respect to the rotational axis direction thereof so as to be rotatable and slidable (movable) in directions toward and away from the photosensitive drum 101. The charging roller 102 is pressed against the photosensitive drum 101 by pressing the above-described bearing members toward the photosensitive drum 101 by roller pressing springs (not shown) constituted by compression coil springs as pressing members. A length of the charging roller 102 with respect to the rotational axis direction is equal to the length of the photosensitive drum 101 with respect to the rotational axis direction.

The cleaning device 106 includes a cleaning blade 1 as a cleaning member and a supporting member 2 supporting the cleaning blade 1. In this embodiment, the supporting member 2 is constituted by including a supporting plate (first metal plate, first supporting member) 3 as a first supporting portion and a swing plate (second metal plate, second supporting member) 4 as a second supporting portion. Further, the cleaning device 106 includes a blade pressing spring 6 which is a pressing member (urging member) as an urging means for pressing (urging) the cleaning blade 1 against the photosensitive drum 101 at a predetermined pressing force (urging portion) by pressing the supporting member 2. Further, the cleaning device 106 includes a collected toner accommodating portion 51 formed by the housing 5 and a feeding screw 7 as a feeding member provided in the collected toner accommodating portion 51. Further, the cleaning device 106 includes a swing shaft (swing pin) 8 as a shaft member for holding a blade assembly 10 (i.e., the cleaning blade 1) described later so as to be swingable (rotatable) by shaft-supporting the swing plate 4 of the supporting member 2.

In this embodiment, the blade assembly (blade unit) 10 is constituted by including the cleaning blade 1, the supporting plate 3, and the swing plate 4. Further, in this embodiment, the supporting member 2 is constituted by including the supporting plate 3 and the swing plate 4.

The cleaning blade 1 is a plate-like (blade-like) member which has predetermined lengths with respect to the longitudinal direction substantially parallel to the rotational axis direction of the photosensitive drum 101 and a widthwise direction substantially perpendicular to the longitudinal direction, which has a predetermined thickness, and which has a substantially rectangular shape as viewed in a flat plane. The cleaning blade 1 is formed with a urethane rubber which is an elastic member. The cleaning blade 1 is disposed counter directionally to the rotational direction (surface movement direction) of the photosensitive drum 101 so that an edge portion E of a free end portion thereof with respect to the widthwise direction contacts a surface (outer peripheral surface). That is, the cleaning blade 1 is disposed so that the free end portion with respect to the widthwise direction faces toward an upstream side of the rotational direction of the photosensitive drum 101. In this embodiment, the swing plate 4 of the cleaning blade 1 is pressed by the blade pressing spring 6 as described later, so that the edge portion E is flexed by being pressed against the surface of the photosensitive drum 101. By this, the cleaning blade 1 contacts the photosensitive drum 101 at predetermined contact pressure. The length of the cleaning blade 1 with respect to the longitudinal direction is, in this embodiment, about 320 mm close to a length of the A3-size recording material P on a short side.

The supporting plate 3 constituting the supporting member 2 is formed by bending a metal plate of about 2 mm in thickness so that a cross section thereof substantially perpendicular to the longitudinal direction has a substantially L-shape. That is, the supporting plate 3 is formed by bending the metal plate so as to include a first flat portion 31 and a second flat portion 32. The first flat portion 31 is disposed so that a planar direction thereof is substantially parallel to the rotational axis direction of the photosensitive drum 101. The second flat portion 32 extends from the first flat portion 31 in a direction crossing (in this embodiment, substantially perpendicular to) the first flat portion 31 and is disposed so that a planar direction thereof is substantially parallel to the rotational axis direction of the photosensitive drum 101. In this embodiment, the second flat portion 32 is disposed so as to extend from the first flat portion 31 toward the photosensitive drum 101 side. The supporting plate 3 is enhanced in rigidity by being bent as described above. The cleaning blade 1 is fixed by bonding of a part thereof on a fixing end portion side opposite from the free end portion thereof with respect to the widthwise direction to the supporting plate 3 (specifically, a part of the first flat portion 31 on an end portion side opposite from the second flat portion 32 with respect to the widthwise direction). Lengths of the first flat portion 31 and the second flat portion 32 of the supporting plate 3 with respect to the longitudinal direction are equal to the length of the cleaning blade 1 with respect to the longitudinal direction.

The swing plate 4 constituting the supporting member 2 is formed by bending a metal plate of about 2 mm in thickness so that a cross section thereof substantially perpendicular to the longitudinal direction has a substantially L-shape. That is, the swing plate 4 is formed by bending the metal plate so as to include a first flat portion 41 and a second flat portion 42. The first flat portion 41 is disposed so that a planar direction thereof is substantially parallel to the rotational axis direction of the photosensitive drum 101. The second flat portion 42 extends from the first flat portion 41 in a direction crossing (in this embodiment, substantially perpendicular to) the first flat portion 41 and is disposed so that a planar direction thereof is substantially parallel to the rotational axis direction of the photosensitive drum 101. In this embodiment, the second flat portion 42 is disposed so as to extend from the first flat portion 41 toward the photosensitive drum 101 side. The swing plate 4 is enhanced in rigidity by being bent as described above. Further, the supporting plate 3 to which the cleaning blade 1 is fixed is fixed to the swing plate 4 with a plurality of screws 21 (see FIG. 9). The plurality of screws 21 are disposed with respect to the longitudinal direction of the supporting plate 3. In this embodiment, the swing plate 4 is disposed so that a side surface of the first flat portion 41 on the photosensitive drum 101 side is disposed on a side surface of the first flat portion 31 of the supporting plate 3 on a side opposite from the photosensitive drum 101, and is fixed to the supporting plate 3. Lengths of the first flat portion 41 and the second flat portion 42 of the swing plate 4 with respect to the longitudinal direction are equal to the length of the cleaning blade 1 with respect to the longitudinal direction. Further, the swing plate 4 is provided with holding portions 43 at opposite end portions thereof with respect to the longitudinal direction. The holding portions 43 are formed by extending opposite end portions of the first flat portion 41 of the swing plate 4 with respect to the longitudinal direction outwardly than opposite end portions of the first flat portion 31 of the supporting plate 3 with respect to the longitudinal direction, respectively, and then by bending the opposite end portions thereof toward the photosensitive drum 101. The holding portions 43 are disposed so that flat surfaces thereof extend in a direction crossing (in this embodiment, substantially perpendicular to) each of the first flat portion 41 of the swing plate 4 and the rotational axis direction of the photosensitive drum 1. Each of the holding portions 43 provided at the opposite end portions of the swing plate 4 with respect to the longitudinal direction is provided with a swing hole (through hole) 44 having a substantially circular shape in cross section (cylindrical shape) with a diameter of about 3 mm. These swing holes 44 are positioned substantially coaxial with each other. Outside these holding portions 43 with respect to the longitudinal direction, side surface portions 52 which are parts of the housing 5 are provided. Each of the side surface portions 52 is provided with supporting holes (through holes) 53 having a substantially circular shape in cross section (cylindrical shape) with a diameter of about 3 mm. These supporting holes 53 are positioned substantially coaxial with the above-described swing holes 43, respectively.

Each of the above-described swing holes 44 and the above-described supporting holes 53 is a through hole, and at an associated one of the opposite end portions of the housing 5 with respect to the longitudinal direction, the swing shaft 8 is inserted into associated ones of the swing holes 44 and the supporting holes 53. The swing shaft 8 is engaged with the swing holes 44 and the supporting holes 53 in a state in which a gap with an engagement tolerance (about 50 μm in gap) is ensured, and shaft-support the blade assembly 10. That is, the blade assembly 10 is supported by the housing 5 so as to be swingable (rotatable) about the swing shaft 8 as a supporting point (swing supporting point, swing axis, rotational axis).

Further, the blade pressing spring 6 constituted by including the compression coil spring is disposed between the swing plate 4 and the housing 5. The blade pressing spring 6 is contacted to (seated on) a first contact portion 45 provided on the swing plate 4 (specifically, a side surface of the first flat portion 41 on a side opposite from the photosensitive drum 101) at one end portion thereof with respect to a coil center axis direction (expansion-contraction direction) of the compression coil spring. Further, the blade pressing spring 6 is contacted to (seated on) a second contact portion 55 provided on the housing 5 at the other end portion thereof with respect to the coil center axis direction (expansion-contraction direction). The blade pressing spring 6 at least generates a rotational force (moment) for rotating the blade assembly 10 about the swing shaft 8 as a supporting point in the counterclockwise direction (CCW direction) in FIG. 3, and is disposed so that the cleaning blade 1 is contacted to the photosensitive drum 101. The blade pressing spring 6 will be specifically described later.

As described above, the blade assembly 10 is swingable about the swing shaft 8 as the supporting point and receives a rotational force by the pressing force of the blade pressing spring 6, so that the cleaning blade 1 is press-contacted to the photosensitive drum 101. Then, the blade assembly 10 scrapes off the residual toner on the rotating photosensitive drum 101 by the edge portion E of the cleaning blade 1, so that cleaning of the surface of the photosensitive drum 101 is carried out.

The residual toner scraped off of the surface of the photosensitive drum 101 by the cleaning blade 1 is accommodated in the collected toner accommodating portion 51. The collected toner accommodating portion 51 is provided in the neighborhood of the housing 5 on a side opposite from the photosensitive drum 101 with respect to the cleaning blade 1. The toner (collected toner) accommodated in the collected toner accommodating portion 51 is fed inside the collected toner accommodating portion 51 by the feeding screw 7. In this embodiment, the collected toner in the collected toner accommodating portion 51 is fed toward one end portion (for example, a front-side end portion) of the collected toner accommodating portion 51 along the rotational axis direction of the photosensitive drum 101 (the longitudinal direction of the cleaning device 106). A wall portion of the above-described one end portion of the housing 5 is provided a discharge opening (not shown). By this, the collected toner fed inside the collected toner accommodating portion 51 is discharged to an outside of the collected toner accommodating portion 51 (the cleaning device 106) through the discharge opening. The collected toner discharged from the collected toner accommodating portion 51 is, as described above, fed through the residual toner feeding portion (not shown) provided in the apparatus main assembly 110 and is stored in the residual toner collecting container (not shown). Then, when the inside of the residual toner collecting container is filled with the collected toner, the residual toner collecting container is exchanged in its entirety. Incidentally, the discharge opening provided in the housing 5 is connected to the residual toner feeding portion provided in the apparatus main assembly 110 when the drum cartridge 111 is mounted in the apparatus main assembly 110.

3. Blade Pressing Supporting Plate

Figure 4:
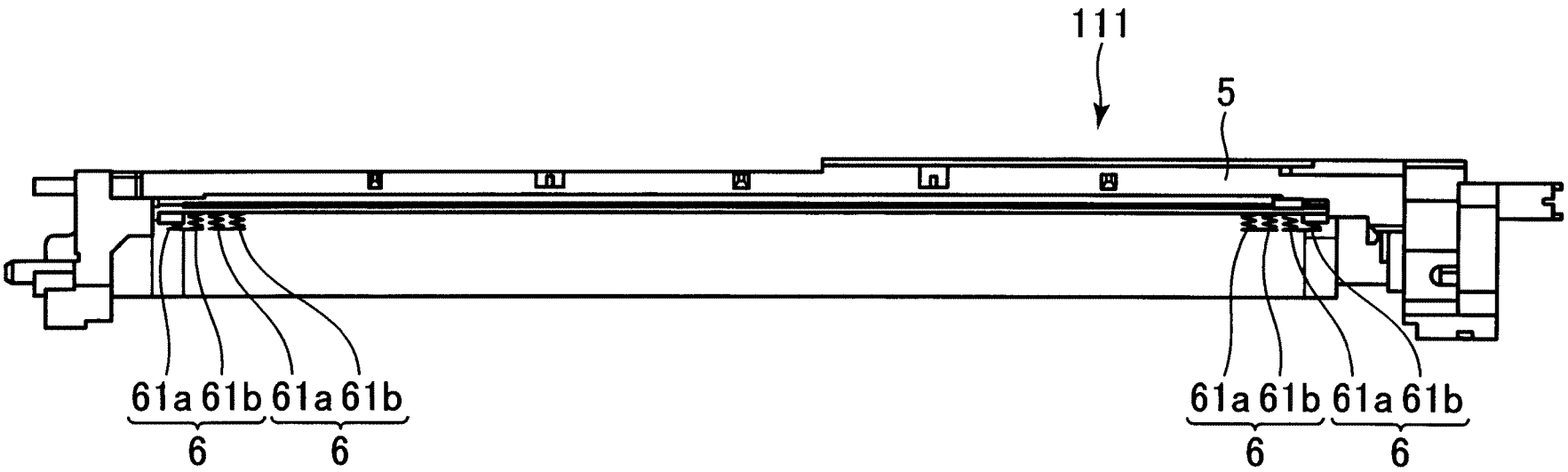
FIG. 4 is a top (plan) view of the drum cartridge.

Next, the blade pressing spring 6 in this embodiment will be specifically described. FIG. 4 is a top view (as viewed in an arrow A direction in FIG. 3) of the drum cartridge 111, showing a state in which the blade pressing spring 6 is held by the housing 5. Incidentally, in FIG. 4, for convenience, many elements other than the housing 5 and the blade pressing spring 6 in the drum cartridge 111 were omitted from illustration. Parts (a) and (b) of FIG. 5 are a perspective view and a top view, respectively, of the blade pressing spring 6 alone in this embodiment. FIG. 6 is a top view showing another example of the blade pressing spring 6.

<Arrangement of Blade Pressing Spring.

First, an arrangement of the blade pressing spring 6 in this embodiment will be described. In this embodiment, as shown in FIG. 4, in the neighborhood of each of the opposite end portions of the housing 5 with respect to the longitudinal direction, a plurality of coil portions (compression coil spring portions) 61 each constituted by the compression coil spring are provided side by side along the longitudinal direction of the housing 5. That is, the plurality of coil portions (compression coil spring portions) 61 are juxtaposed in a direction crossing a coil center axis direction of each coil portion. Particularly, in this embodiment, as specifically described later, four blade pressing springs 6 each including two coil portions 61 (first coil portion 61*a* and second coil portion 61*b*) which are integrally formed are arranged in parallel in the longitudinal direction of the housing 5. Specifically, the two blade pressing springs 6 each including the two coil portions 61 (first coil portion 61*a* and second coil portion 61*b*) which are integrally formed are arranged in parallel in the neighborhood of each of the opposite end portions of the housing 5 with respect to the longitudinal direction. That is, in this embodiment, to the swing plate 4, the pressing force is applied by the eight coil portions 61 in total. In this embodiment, these eight coil portions 61 are juxtaposed substantially in parallel to the rotational axis direction of the photosensitive drum 101.

Incidentally, in a constitution in which the residual toner is removed by pressing the cleaning blade against the photosensitive drum with the compression coil spring, an operation (working) length (L in FIG. 3) of the compression coil spring fluctuates depending on a part tolerance. Incidentally, the operation length L is a length with respect to the coil center axis direction (expansion-contraction direction) in an operation state in which the compression coil spring applies a pressing force to an object to be pressed. For example, in the case where a manufacturing variation occurs at the following position, the operation length L of the compression coil spring changes. That is, for example, there is a positional tolerance (H in FIG. 3) between the second contact portion 55 and a center of the supporting hole 53 of the housing 5. Further, for example, there is a positional tolerance (D in FIG. 3) between a center of the swing hole 44 and the first contact portion 45 of the swing plate 4. Further, when the operation length L of the compression coil spring fluctuates, correspondingly thereto, the pressing force applied from the compression coil spring to the blade assembly 10 also fluctuates. At this time, when the operation length of the compression coil spring fluctuating due to the above-described part tolerance ΔL, a corresponding fluctuation amount ΔF of the pressing force applied from the compression coil spring to the blade assembly 10 is acquired by the following formula.

$$\Delta F = k \times \Delta L \quad (1)$$

Here, k represents a spring constant of the compression coil spring alone, and is acquired by the following formula, and is determined depending on a material and a shape of the compression coil spring alone.

$$k = (G \times d4)/(8 \times N \times D3) \quad (2)$$

G: modulus of rigiditd: coil wire diameter

D: coil average diameter

N: Number of active coils

As is understood from the formula (1), in order to minimize the fluctuation amount ΔF applied from the compression coil spring to the blade assembly 10, the spring constant may preferably be set at a small value to the extent possible. As one of means for decreasing the spring constant k, from the formula (2), it is possible to cite a change in coil averaged diameter D, coil wire diameter d and number of active coils N (the modulus of rigidity G is determined by a material of the spring, and therefore, a degree of freedom of design is low). However, in some cases, it is difficult to change the coil average diameter D, the coil wire diameter d, and the number of active coils N for the reasons described later, with the result that the spring constant k can be made small in some cases when the plurality of compression coil springs are disposed in parallel to each other.

First, it is known that shearing stress T0 exerted on the compression coil spring when a predetermined load P is applied to the compression coil spring is represented by the following formula.

$$T0 = 8 \times N \times D^3 \times P/(G \times d)^4 \quad (3)$$

P: predetermined pressing force

This formula (3) has been widely used as an index of disruptive strength of the compression coil spring.

Here, when the case where the compression coil spring is disposed alone and the case where the plurality of compression coil springs are disposed in parallel are compared to each other, when the predetermined pressing force P is needed, in the case where the plurality of compression coil springs are disposed in parallel, it is only required that a value of the sum of pressing forces generated by the respective compression coil springs becomes the predetermined pressing force P. On the other hand, in the case where the compression coil spring is disposed alone, there is a need that the compression coil spring generates the predetermined pressing force singly. Then, the shearing stress T0 applied to the compression coil spring alone is larger in the case where the compression coil spring is disposed alone than in the case where the plurality of compression coil springs are disposed in parallel. For example, the shearing stress in the case where the compression coil spring is disposed alone is twice the shearing stress in the case where two compression coil springs are disposed in parallel. For this reason, in the case where the compression coil spring is disposed alone, the shearing stress exceeds allowable shearing stress, so that there is a possibility that the compression coil spring is broken.

In order to decrease the shearing stress T0, from the formula (3), there is a need that the coil average diameter D is decreased or the coil wire diameter d is increased. However, in the case where the coil average diameter D, it is difficult to perform processing due to a limit of a processing property of the compression coil spring and there is a liability of breakage of the compression coil spring since locally generating stress due to the decrease in coil average diameter D becomes excessively large, so that the coil average diameter D cannot be employed in some instances. Further, when the coil average diameter is decreased, from the formula (2), the spring constant increases by the third power. Further, also, as regards the coil wire diameter, the shearing stress T0 can be decreased by increasing coil wire diameter, but from the formula (2), the spring constant increases by the fourth power. For this reason, even when the strength is satisfied, the spring constant in the case where the compression coil spring is disposed alone becomes larger than the spring constant in the case where the plurality of compression coil springs are disposed in parallel, in some instances.

Further, when the spring constant is intended to be decreased by increasing the number of active coils N, the shearing stress T0 also increases, so that the disruptive strength falls into an insufficient state in some cases.

For the above-described reasons, by disposing the plurality of compression coil springs in parallel to each other, total spring constant can be consequently decreased while lowering the shearing stress exerted on each of the compression coil springs. For example, when the same pressing force P is generated, between the case where two compression coil spring each having a spring constant of k1 are disposed in parallel and the case where a single compression coil spring having a spring constant of k2 is disposed alone, the spring constants k1 and k2 can be made so as to satisfy the following relationship.

$$2\times k1\times k2.$$

In the cleaning device 106 in this embodiment, with respect to the longitudinal direction, there is a space latitude for disposing the compression coil springs. On the other hand, there is a limit to a space for the compression coil springs with respect to an operation length direction. This is because an increase in size of the compression coil springs with respect to the operation length direction (left-right direction in FIG. 3) leads to an increase in size of the cleaning device 106 with respect to the operation length direction, by extension to an increase in size of the image forming apparatus 100 with respect to the widthwise direction. In such a constitution, by disposing the plurality of compression coil springs in parallel, the spring constant of the compression coil springs is decreased while effectively utilizing the space, so that it is possible to decrease a degree of a fluctuation in pressing force with a fluctuation in operation length L by decreasing the spring constant of the compression coil springs.

For the above-described reasons, in this embodiment, as described above, the eight coil portions 61 are arranged in total with respect to the longitudinal direction of the cleaning device 106, and the swing plate 4 is pressed by each of the coil portions 61.

Further, in this embodiment, as shown in FIG. 4, the plurality of coil portions 61 are provided in the neighborhood of each of the opposite end portions of the housing 5 with respect to the longitudinal direction. Here, a distribution of the pressing force of the cleaning blade 1 against the photosensitive drum 101 with respect to the longitudinal direction may desirably be made flat to the extent possible. For example, in the case where this distribution of the pressing force with respect to the longitudinal direction projects at a central portion, the cleaning blade 1 is turned up from the photosensitive drum 101, so that there is a possibility that improper cleaning occurs. For that reason, in this embodiment, the plurality of coil portions 61 are provided in the neighborhood of each of the opposite end portions of the housing 5 with respect to the longitudinal direction, so that it is suppressed that the distribution of the pressing force with respect to the longitudinal direction becomes high at the central portion.

<Shape of Blade Pressing Spring>

Next, the shape of the blade pressing spring 6 in this embodiment will be described. Part (a) of FIG. 5 is a perspective view showing the blade pressing spring 6, and part (b) of FIG. 5 is a top view of the blade pressing spring 6. Incidentally, part (b) of FIG. 5 is the top view as viewed in an arrow B direction in part (a) of FIG. 5, specifically, is the top view as viewed substantially in parallel to a coil center axis Sa of the first coil portion 61*a* and a coil center axis Sb of the second coil portion 61*b* which are described later.

As shown in part (a) of FIG. 5, the blade pressing spring 6 includes the first coil portion 61*a*, the second coil portion 61*b*, and a connecting portion 61*c*. In this embodiment, the first coil portion 61*a*, the second coil portion 61*b*, and the connecting portion 61*c* are integrally formed by a single wire material (for example, a hard steel wire). Each of the first coil portion 61*a* and the second coil portion 61*b* has a helical-shaped portion, and this helical-shaped portion is compressed, so that a pressing force is generated. The coil center axis Sa of the first coil portion 61*a* and the coil center axis Sb of the second coil portion 61*b* are substantially parallel to each other. The blade pressing spring 6 is formed by a single wire material so that one end portion (connecting end portion) 62*a* of the first coil portion 61*a* and one end portion (connecting end portion) 62*b* of the second coil portion 61*b* are connected by the connecting portion 61*c*. Further, each of the other end portion of the first coil portion 61*a* and the other end portion of the second coil portion 61*b* is a free end (terminal), where a first coil free end (terminal) 63*a* and a second coil free end (terminal) 63*b* are formed, respectively.

In this embodiment, the connecting portion 61*c* is a portion protruded from helical coil portions when the first coil portion 61*a* and the second coil portion 61*b* are viewed in a coil center axis direction.

Here, as shown in part (a) of FIG. 5, in this embodiment, the connecting portion 61*c* includes a crossing portion 64 crossing a plane F passing through the coil center axis Sa of the first coil portion 61*a* and the coil center axis Sb of the second coil portion 61*b*. By this, the first coil portion 61*a* and the second coil portion 61*b* have the same winding direction (right winding direction in either of examples shown in parts (a) and (b) of FIG. 5). Further, as shown in part (b) of FIG. 5, in this embodiment, the connecting portion 61*c* has a rotationally symmetrical shape of about 180° with respect to a connecting axis Sc described later. That is, in part (b) of FIG. 5, an axis which passes through a midpoint of a line segment l connecting the coil center axis Sa of the first coil portion 61*a* and the coil center axis Sb of the second coil portion 61*b* and which is substantially parallel to the above-described coil center axis Sa is the connecting axis Sc. At this time, the connecting portion 61*c* has a shape which is the substantially same shape even in the case where the connecting portion 61*c* is rotated 180° about the connecting axis Sc. By this, the connecting portion 61*c* has the substantially same shape even in the case where the connecting portion 61*c* is rotated 180° about the connecting axis Sc when the blade pressing spring 6 is assembled with the housing 5. For that reason, the influence of the cleaning blade 1 on the pressing force against the photosensitive drum 101 depending on a manner of assembling of the blade pressing spring 6 can be made very small. Further, an operator does not worry about an assembling direction of the blade pressing spring 6 during assembling, and therefore, the operator is capable of easily assembling the blade pressing spring 6.

Incidentally, in an example shown in parts (a) and (b) of FIG. 5, the connecting portion 61*c* has a shape following a line segment connecting tangential lines of coil average and diameters of the first coil portion 61*a* and the second coil portion 61*b*. However, the shape of the connecting portion 61*c* is not limited to this shape, but even in the case where the connecting portion 61*c* is rotated 180° about the connecting axis Sc, an effect similar to the above-described effect can be obtained when the shape thereof is substantially the same shape even in the case where the connecting portion 61*c* is rotated 180° about the connecting axis Sc. FIG. 6 is a top view showing another example of the blade pressing spring 6 as viewed in the same direction as in part (b) of FIG. 5. For example, as shown in FIG. 6, the connecting portion 61*c* may also have a substantially Z-shape comprised of three line segments.

4. Assembling Method

Next, an assembling method of the blade pressing spring 6 and the blade assembly 10 with the housing 5 will be described. FIG. 7 is a perspective view showing a state in which the blade pressing spring 6 is temporarily held by the housing 5. Further, part (a) of FIG. 8 is a left side (surface) view (side view as viewed from the photosensitive drum 101 side) showing a state in which the blade pressing spring 6 is normally assembled with the housing 5. Further, part (b) of FIG. 8 is a sectional view (along A-A line shown in part (a) of FIG. 8) for illustrating a constitution for preventing erroneous assembling of the blade pressing spring 6. Further, FIG. 9 is a perspective view showing a state in which the blade assembly 10 and the swing shaft 8 are assembled with the housing 5. Incidentally, FIG. 7 and FIG. 8 show a constitution relating to the two blade pressing springs 6 (four coil portions 61) disposed on one end portion side of the housing 5, but a constitution on the other end portion side is also similar to the constitution on one end portion side.

<Temporary Assembling of Blade Pressing Spring to Housing>

As shown in FIG. 7, the housing 5 is provided with a first groove portion 56*a* as a first coil accommodating portion having a substantially cylindrical shape and a second groove portion 56*b* has a second coil accommodating portion having a substantially cylindrical shape, in which the first coil portion 61*a* and the second coil portion 61*b* of the blade pressing spring 6 enter, respectively. The blade pressing spring 6 is temporarily held by the housing 5 by causing parts of the first coil portion 61*a* and the second coil portion 61*b* on one end portion side (opposite from the blade assembly 10) with respect to the coil center axis direction) to enter the first groove portion 56*a* and the second groove portion 56*b*, respectively. A predetermined clearance is provided between an outer diameter of the coil portion 61 and an inner diameter of the groove 56 so that the coil portion 61 (first coil portion 61*a*, second coil portion 61*b*) is not caught by an edge 56*c* of the groove 56 (first groove portion 56*a*, second groove portion 56*b*) when the coil portion 61 of the blade pressing spring 6 expands and contracts. As shown in parts (a) and (b) of FIG. 8, the bottom provided at an end portion of the groove portion 56 on a side opposite from the blade assembly 10 is the above-described second contact portion 55.

The blade pressing spring 6 is assembled to the housing 5 so that the coil free end 63 (first coil free end 63*a*, second coil free end 63*b*) is on the second contact portion 55 side of the housing 5 and the connecting portion 61*c* is on the blade assembly side. As shown in parts (a) and (b) of FIG. 8, in this embodiment, the housing 5 is provided with an erroneous assembling prevention shape portion (preventing portion) 56*d* for preventing erroneous assembling of the blade pressing spring 6. By this, the blade pressing spring 6 is prevented from being erroneously assembled so that the connecting portion 61*c* is on the second contact portion 55 side of the housing 5 in a manner contrary to the above-described manner. Specifically, in this embodiment, as shown in part (b) of FIG. 8, the housing 5 is provided with a rib 56*d* as the preventing portion between the first groove portion 56*a* and the second groove portion 56*b* for receiving the first coil portion 61*a* and the second coil portion 61*b*, respectively, of the blade pressing spring 6. The rib 56*d* extends from the bottom of the groove portion 56 toward the blade assembly 10 in a sufficient length. When the blade pressing spring 6 is intended to be assembled to the housing 5 in a state in which the connecting portion 61*c* is on the second contact portion 55 side of the housing 5 (arrow W direction in part (b) of FIG. 8), the rib 56*d* contacts and interferes with the connecting portion 61*c*. Incidentally, when the blade pressing spring 6 is assembled to the housing 5 in a state in which the connecting portion 61*c* faces toward the blade assembly 10 side, the rib 56*d* does not contact the connecting portion 61*c*. By this, the erroneous assembling as described above is prevented. Further, in this embodiment, as shown in an enlarged perspective view in part (b) of FIG. 8, the rib 56*d* is provided with a cut-away portion 56*e* for preventing that the rib 56*d* interferes with the connecting portion 61*c* when a normally assembled blade pressing spring 6 is compressed. That is, in this embodiment, the erroneous assembling prevention shape portion 56*d* is constituted by the rib 56*d* constituting a part of the edge 56*c* of the groove portion 56, and the cut-away portion 56*e* is provided so that a height of a part (end portion of the rib 56*d* on the blade assembly side) of the edge 56*c* is made lower than a height of another part of the edge 56*c*.

Incidentally, as described above, in this embodiment, as regards a rotational direction of the blade pressing spring 6 relative to the connecting axis Sc, even when the connecting portion 61*c* is rotated 180°, the connecting portion 61*c* has the substantially same shape, and therefore, the blade pressing spring 6 is assembled with no problem of erroneous assembling.

<Assembling of Blade Assembly>

Then, as shown in FIG. 9, the blade assembly 10 is assembled to the housing 5 in an arrow As direction.

Here, an effect by connection of the first coil portion 61*a* and the second coil portion 61*b* of the blade pressing spring 6 through the connecting portion 61*c* and an effect by positioning of the connecting portion 61*c* on the blade assembly side will be described. FIG. 10 and parts (a) and (b) of FIG. 11 are schematic sectional views (cross sections passing through the coil center axis) each for illustrating a state during the assembling in the case where the conventional compression coil spring comprised of a single cleaning device is used.

First, as shown in FIG. 10, if a compression coil spring 200 comprised of a single coil portion is used, the compression coil spring 200 contacts the first contact portion 45 of the swing plate 4 at a terminal (end) thereof. In this case, as shown in FIG. 10, when the blade assembly 10 is assembled in the arrow As direction, the blade assembly 10 is assembled in some instances in a state in which the compression coil spring 200 is inclined relative to the swing plate 4. Falling of the compression coil spring 200 due to a variation in attitude of the compression coil spring 200 and a clearance provided between the compression coil spring 200 and the groove portion 56 of the housing 5 occurs in some cases. Then, there is a possibility that the compression coil spring 200 is not seated at a predetermined position of the swing plate 4 and is detached from the swing plate 4. This is also applied to the case where the connecting portion 61*c* is positioned on the second contact portion side of the housing 5 even when the blade pressing spring 6 includes the connecting portion 61*c* connecting the first coil portion 61*a* and the second coil portion 61*b*.

On the other hand, in this embodiment, as regards the blade pressing spring 6, the first coil portion 61*a* and the second coil portion 61*b* are connected by the connecting portion 61*c*. Further, in this embodiment, the connecting portion 61*c* of the blade pressing spring 6 is positioned on the blade assembly side. For that reason, according to this embodiment, falling of the first coil portion 61*a* and falling of the second coil portion 61*b* are suppressed by each other, so that assembling of the blade assembly becomes easy, and by extension, that ease of assembling of the cleaning device 106 is improved.

Further, according to this embodiment, a pressing point when the blade pressing spring 6 presses the swing plate 4 in contact with the first contact portion 45 of the swing plate 4 is stabilized, so that a pressing force of the blade pressing spring 6 against the blade assembly 10 is stabilized. This is because the first coil portion 61*a* and the second coil portion 61*b* are connected by the connecting portion 61*c* and the connecting portion 61*c* is positioned on the blade assembly side.

That is, as shown in parts (a) and (b) of FIG. 11, if the compression coil spring 200 comprised of the single coil portion is used, the compression coil spring 200 is assembled with the housing 5 irrespective of a phase thereof with respect to the coil center axis. For that reason, as regards an end 201 of the compression coil spring 200, depending on an assembling phase of the compression coil spring 200, for example, the case where the end 201 is positioned at a lower end as shown in part (a) of FIG. 11 and the case here the end 201 is positioned at an upper end as shown in part (b) of FIG. 11 can occur. Then, the pressing force applied from the compression coil spring 200 to the swing plate 4 causes a distribution difference as shown by fin parts (a) and (b) of FIG. 11 between the case shown in part (a) of FIG. 11 and the case shown in part (b) of FIG. 11. As a result, depending on the assembling phase of the compression coil spring 200, a variation in pressing force of the cleaning blade 1 against the photosensitive drum 101 occurs.

This is also applied to the case where the connecting portion 61*c* is positioned on the second contact portion side of the housing 5 even when the blade pressing spring 6 includes the connecting portion 61*c* connecting the first coil portion 61*a* and the second coil portion 61*b*. That is, in general, when a constitution of the spring is determined on a spring pressing force priority basis, an amount corresponding to a fluctuation in pressing force due to tolerances of a spring wire diameter and a coil diameter is intended to be absorbed by the number of winding of coils, and therefore, a coil end position varies in some instances. Also, in this case, due to a variation in tolerance of positions of ends (first coil free end 63*a*, second coil free end 63*b*) of the coil portion 61, there is a possibility that a variation in pressing force from the blade pressing spring 6 to the swing plate 4 similar to the above-described variation in pressing force occurs.

On the other hand, in this embodiment, in the blade pressing spring 6, the first coil portion 61*a* and the second coil portion 61*b* are connected by the connecting portion 61*c*. Further, in this embodiment, the connecting portion 61*c* of the blade pressing spring 6 is positioned on the blade assembly side. For that reason, the blade pressing spring 6 contacts the first contact portion 45 of the swing plate 4 along a fixed edge line (connecting portion 61*c*, particularly, in the neighborhood of the connecting axis Sc in this embodiment), so that a pressing point of the blade pressing spring 6 against the swing plate 4 is stabilized. As a result, it becomes possible to stabilize the pressing force of the cleaning blade 1 against the photosensitive drum 101. Further, as described above, according to this embodiment, as regards the rotational direction of the blade pressing spring 6 about the connecting axis Sc, even when the blade pressing spring 6 is assembled by being rotated 180°, the connecting portion 61*c* has the substantially same shape. For that reason, there is little fluctuation in pressing force with respect to the rotational direction due to the manner of assembling of the blade pressing spring 6, so that a stable pressing force can be obtained irrespective of the manner of assembling.

Incidentally, in this embodiment, the end (first coil free end 63*a*, second coil free end 63*b*) of the coil portion 61 is disposed on the second contact portion side of the housing 5. For that reason, a fluctuation in pressing point can occur on the second contact portion side. However, the end of this coil portion 61 does not directly press the blade assembly 10, and therefore, the fluctuation has no influence on the pressing force of the cleaning blade 1 against the photosensitive drum 101 or is at a negligible degree.

<Assembling of Swing Shaft>

Referring again to FIG. 9, after the blade assembly 10 is mounted (disposed) at a predetermined position, at each of the opposite end portions of the housing 5 with respect to the longitudinal direction, the swing shaft 8 is inserted into the swing hole 44 of the swing plate 4 and the supporting hole 53 of the housing 5 from an outside of the housing 5 in this embodiment. By this, the blade assembly 10 is shaft-supported by the swing shaft 8 and is supported by the housing 5 so as to be swingable about the swing shaft 8 as a supporting point.

5. Effect

As described above, the cleaning device 106 of this embodiment includes the cleaning blade 1 for removing the toner from the surface of the rotatable member 101 in contact with the surface of the rotatable member 101, the supporting member 2 supporting the cleaning blade 1, the housing 5 swingably holding the supporting member 2, and the blade pressing spring 6 which is disposed between the supporting member 2 and the housing 5 and which presses the supporting member 2 so as to press the cleaning blade 1 against the rotatable member 101. Further, the blade pressing spring 6 includes the first coil portion 61*a* constituted by the compression coil spring disposed between the supporting member 2 and the housing 5 so as to be expandable and contractable, the second coil portion 61*b* constituted by the compression coil spring disposed between the supporting member 2 and the housing 5 so as to be expandable and contractable, and the connecting portion 61*c* integrally connecting the first coil portion 61*a* and the second coil portion 61*b*, and the connecting portion 61*c* connects the first coil portion 61*a* and the second coil portion 61*b* by connecting the end portion of the first coil portion 61*a* on the supporting member side and the end portion of the second coil portion 61*b* on the supporting member side and is disposed on the supporting member side. In this embodiment, the coil center axis Sa of the first coil portion 61*a* and the coil center axis Sb of the second coil portion 61*b* are substantially parallel to each other. Further, in this embodiment, the connecting portion 61*c* includes the crossing portion 64 crossing the plane F passing through the coil center axis Sa of the first coil portion 61*a* and the coil center axis Sb of the second coil portion 61*b*. Further, in this embodiment, when the connecting portion 61*c* is viewed substantially parallel to the coil center axis Sa of the first coil portion 61*a*, the connecting portion 61*c* has the shape which is the substantially same shape in the case where the connecting portion 61*c* is rotated 180° about the connecting axis Sc which passes through the midpoint of the line segment l connecting the coil center axis Sa of the first coil portion 61*a* and the coil center axis Sb of the second coil portion 61*b* and which is substantially parallel to the coil center axis Sa of the first coil portion 61*a*. Further, in this embodiment, the connecting portion 61*c* has the shape following the line segment connecting the tangential lines of the coil average diameters of the first coil portion 61*a* and the second coil portion 61*b*.

Further, in this embodiment, each of the end portions of the first coil portion 61*a* and the second coil portion 61*b* on the housing side is the free end. Further, in this embodiment, the housing 5 includes the first coil accommodating portion 56*a* for accommodating at least a part of the first coil portion 61*a* and the second coil accommodating portion 56*b* for accommodating at least a part of the second coil portion 61*b*. Further, in this embodiment, between the first coil accommodating portion 56*a* and the second coil accommodating portion 56*b*, the preventing portion 56*d* which does not contact the connecting portion 61*c* in the case where the blade pressing spring 6 is assembled to the housing 5 so that the connecting portion 61*c* faces toward the supporting member side and which prevents that the first coil portion 61*a* and the second coil portion 61*b* are accommodated in the first coil accommodating portion 56*a* and the second coil accommodating portion 56*b*, respectively, in contact with the connecting portion 61*c* in the case where the blade pressing spring 6 is intended to be assembled to the housing 5 so that the connecting portion 61*c* faces toward the housing side. Further, in this embodiment, the supporting member 2 includes the plate 3 to which the cleaning blade 1 is fixed and the swing plate 4 to which the plate 3 is fixed, and is swingably held by the housing 5 by shaft-supporting the swing plate 4.

According to this embodiment, it is possible to suppress the falling of the coil portion 61 during the assembling of the blade assembly 10, and the blade pressing spring 6 can be mounted without concerning about the phase of the coil portion 61 with respect to the coil center axis. Further, according to this embodiment, the pressing point of the blade pressing spring 6 against the swing plate 4 is stabilized. By this, the assembling becomes easy, and it becomes possible to obtain a stable pressing force of the cleaning blade 1 against the photosensitive drum 101. That is, according to this embodiment, the assembling the blade pressing spring 6 and the blade assembly 10 becomes easy, and it becomes possible to obtain the stable pressing force with a small variation in pressing force of the cleaning blade 1 against the photosensitive drum 101 due to a part tolerance. Accordingly, according to this embodiment, the pressing force of the cleaning blade 1 against the photosensitive drum 101 can be stabilized, and the assembling of the cleaning device 106 can be made easy.

Embodiment 2

Next, another embodiment of the present invention will be described. Basic constitution and operation of an image forming apparatus of this embodiment are the same as those in Embodiment 1. Accordingly, elements having identical or corresponding functions or constitutions to those of the image forming apparatus of Embodiment 1 are represented by the same reference numerals or symbols as those in Embodiment 1 and will be omitted from detailed description.

In the embodiment 1, the supporting member 2, was constituted by including the supporting plate 3 and the swing plate 4, and the blade pressing spring 6 applied the pressing force to the swing plate 4 in contact with the first contact portion 45 of the swing plate 4. However, the present invention is not limited to such a constitution. FIG. 12 is a schematic sectional view (cross section substantially perpendicular to the rotational axis direction of the photosensitive drum 101) of the drum cartridge 111, showing another example of the supporting member 2. For example, as shown in FIG. 12, the supporting member 2 supporting the cleaning blade 1 does not include the swing plate 4 in the embodiment 1, and the cleaning blade 1 may also be constituted by the supporting plate 3 to which the cleaning blade 1 is fixed by bonding. This supporting plate 3 is swingable supported by the housing 5 similarly as the swing plate 4 in the embodiment 1. In this case, the blade pressing spring 6 applies the pressing force in contact with a first contact portion 35 provided on the supporting plate 3 to which the cleaning blade 1 is fixed. Further, the blade pressing spring 6 is contacted to a contact member (not shown), constituting the first contact portion, which is constituted by a member other than the supporting plate 3 and the swing plate 4 and which is fixed to the supporting plate 3 or the swing plate 4, so that the pressing force may also be applied. Also, in this case, the first contact portion can be regarded as being provided on the supporting member (supporting plate 3 or swing plate 4). Also, by these constitutions, an effect similar to the effect of the embodiment 1 is obtained.

Further, in the embodiment 1, as shown in part (a) of FIG. 8, the plurality of coil portions 61 of the blade pressing spring 6 were disposed substantially parallel to the rotational axis direction. However, the present invention is not limited to such a constitution. FIG. 13 is a side view, as viewed in a direction similar to the direction of part (a) of FIG. 8, showing another example of the arrangement of the plurality of coil portions 61 of the blade pressing spring 6. For example, as shown in FIG. 13, the first coil portion 61*a* and the second coil portion 61*b* of the blade pressing spring 6 may also be disposed obliquely with respect to the rotational axis direction. Also, by this constitution, an effect similar to the effect of the embodiment 1 is obtained.

Further, in the embodiment 1, the connecting portion 61*c* of the blade pressing spring 6 had the shape which is the substantially same shape even in the case where the connecting portion 61*c* is rotated 180° about the connecting axis Sc. By this, as described in the embodiment 1, irrespective of a manner of assembling of the blade pressing spring 6 with respect to the rotational direction, it is possible to obtain an excellent effect such that the pressing point of the blade pressing spring 6 is stabilized. However, it becomes desirable that the assembling manner with respect to the rotational direction is uniformized, but even when the following constitution is employed, a corresponding effect is obtained in terms of improvements in ease of the assembling and stability of the pressing point. FIG. 14 is a top view showing another example of the blade pressing spring 6 as viewed in the same direction as the direction of part (b) of FIG. 5. As shown in FIG. 14, the connecting portion 61*c* does not include the crossing portion 64 crossing the plane F described with reference to part (a) of FIG. 5 and may also be disposed only on one side with respect to the plane F. Also, in this case, the connecting portion 61*c* of the blade pressing spring 6 is disposed on the blade assembly side similarly as in the embodiment 1. Further, in this case, as seen along the longitudinal direction of the cleaning blade 1, the connecting portion 61*c* may desirably be disposed on a side (corresponding to upper side in FIG. 3) opposite from the swing shaft 8 (swing axis of the blade assembly 10) with respect to the above-described plane F. By this, the blade assembly 10 can be pressed at a position further away from the swing supporting point, so that in order to obtain the same pressing force of the cleaning blade 1 against the photosensitive drum 101, it is possible to use the blade pressing spring 6 with a smaller pressing force. For that reason, it is advantageous in terms of a decrease in degree of a fluctuation in pressing force relative to a fluctuation in operation length due to the part tolerance or the like, or simplification of the constitution, and reduction in cost.

Further, in the embodiment 1, in the embodiment 1, all the blade pressing springs 6 provided in the cleaning device 106 were such that the first coil portion 61*a* and the second coil portion 61*b* are connected by the connecting portion 61*c*. By this, the effect described in the embodiment 1 can be obtained most conspicuously. However, for example, in order to meet a minor change in device constitution or to meet a design requirement regarding pressing of the cleaning blade 1, as at least one of the plurality of coil portions, the compression coil spring 200 comprised of the single coil portion may also be used in combination. In this case, for example, as shown in part (a) of FIG. 15, it is preferable that of the plurality of coil portions, the number of the coil portions included in the blade pressing springs 6 connected by the connecting portions 61*c* is larger than the number of the compression coil springs each comprised of the single coil portion. By this, the influence of the use of the compression coil springs each comprised of the single coil portion on the effect described in the embodiment 1 can be made relatively small. Incidentally, part (a) of FIG. 15 is a schematic view showing a plurality of coil portions provided on one end portion side of the housing 5 with respect to the longitudinal direction.

Further, in the embodiment 1, the blade pressing spring 6 including the plurality of coil portions connected included the two (even number) coil portions 61. However, the present invention is not limited to such an embodiment, but the number of the coil portions 61 connected may also be three or more. For example, as shown in part (b) of FIG. 15, the blade pressing spring 6 may also include three (odd number) coil portions 61. This blade pressing spring 6 has a constitution such that to an end of at least one coil portion 61 of the blade pressing spring 6 described in the embodiment 1, a third coil portion 61*e* is connected by connecting portion 61*d*. In this case, the end of the third coil portion 61*e* is positioned on the blade assembly side. However, when the number of the coil portions 61 connected by the connecting portion 61*c* disposed on the blade assembly side is larger than the number of the coil portions 61 each having the end disposed on the blade assembly side, the effect described in the embodiment 1 can be correspondingly obtained. Further, it is possible to intend to further increase the number of the coil portions 61 connected in accordance with the example shown in part (b) of FIG. 15 so that the number of the coil portions 61 is increased to four (even number) and five (odd number). However, a desired number of coil portions can be achieved by appropriately combining the blade pressing spring 6 described in the embodiment 1 and the blade pressing spring 6 shown in part (b) of FIG. 15.

Further, in the embodiment 1, the present invention is applied to the cleaning device 106 which is a cleaning means of the photosensitive member as the rotatable member, but is not limited to such an embodiment. The present invention is also applicable to, for example, the belt cleaning device 140 (FIG. 1) which is a cleaning means for the intermediary transfer member as the rotatable member, and it is possible to obtain an effect similar to the effect described in the embodiment 1. Further, the rotatable member as a cleaning object of the cleaning device is not limited to the photosensitive drum and the intermediary transfer belt. The rotatable member as the cleaning object of the cleaning device is, for example, a recording material carrying belt constituted by an endless belt, as a recording material carrying member for carrying and conveying the recording material onto which the toner image formed on the image bearing member such as the photosensitive drum is transferred. Further, in addition, the rotatable member may also be a photosensitive belt, an electrostatic dielectric (member) belt, or belts as a rotatable member and a rotatable pressing member which are provided in the image heating device for heating the recording material. That is, typically, the rotatable member as the cleaning object of the cleaning device in an image conveying member for conveying the toner image or the recording material carrying thereon the toner image.

Further, in this embodiment, the case where the cleaning device to which the present invention is applied is contained in the drum cartridge capable of mountable in and dismountable from the apparatus main assembly was described, but the present invention is not limited to such an embodiment. The cleaning device may also be one which cannot be easily mounted in and dismountable from the apparatus main assembly. Further, the cleaning device may also be integrally constituted with at least one of the photosensitive member, the charging means, and the developing means and may also be made mountable in and dismountable from the apparatus main assembly. Further, the cleaning device may also be made mountable in and dismountable from the apparatus main assembly substantially singly.

Embodiment 3

Next, another embodiment of the present invention will be described. In the embodiments 1 and 2, by employing the following constitution, it becomes possible to further improve an assembling property of the blade pressing spring 6 and the blade assembly 10. Elements having identical or corresponding functions or constitutions to those in the embodiments 1 and 2 are represented by the same reference numerals or symbols as those in the embodiments 1 and 2 and will be omitted from detailed description.

Incidentally, a constitution of this embodiment is applicable to, for example, the case where the compression coil spring comprised of the single coil portion is used as at least one of the plurality of coil portions (see the embodiment 2) or the case where only the compression coil spring comprised of the single coil portion. Accordingly, in this embodiment, the compression coil spring corresponding to one constituting the coil portion 61 in the above-described embodiments is simply referred to as the "blade pressing spring 6". In this embodiment, the "blade pressing spring 6" may constitute one in which the first coil portion 61*a* and the second coil portion 61*b* are connected by the connecting portion 61*c* as described in the above-described embodiments or may also constitute the compression coil spring comprised of the single compression coil portion. In FIGS. 16 and 18, this "blade pressing spring 6" is shown as the blade pressing spring 6 constituting one in which the first coil portion 61*a* and the second coil portion 61*b* are connected by the connecting portion 61*c* as described in the above-described embodiments.

<Constitution of Housing>

FIG. 16 is a sectional view, for illustrating the constitution of this embodiment, of the housing 5 to which the blade assembly 10 is assembled, in the neighborhood of the blade pressing spring 6. FIG. 16 is the sectional view at a position similar to the position of the cross-sectional line A-A in part (a) of FIG. 8 and shows the constitution of the housing 5 on one end portion side with respect to the longitudinal direction, but the constitution of the housing 5 on the other end portion side is similar to the constitution.

As described in the embodiments 1 and 2, in the housing 5, the plurality of blade pressing springs 6 are disposed in parallel to each other. The housing 5 is provided with receiving portions 5*a* on which the blade pressing springs 6 are seated at an end portion, opposite from the photosensitive drum 101, of groove portions 5*b* (corresponding to the groove portions 56 in the embodiments 1 and 2) for receiving the blade pressing springs 6. Further, each of the receiving portions 5*a* is provided with a through hole 30. The through hole 30 is provided so as to penetrate a region defined by the receiving portion 5*a* (seating region) where the blade pressing spring 6 is seated and to penetrate a side wall of the housing 5. In this embodiment, the through hole 30 has a substantially cylindrical shape which is substantially circular in cross section. This through hole 30 improves the assembling property by insertion of a guiding pin 33*a* through the through hole 30 described later when the blade pressing spring 6 and the blade assembly 10 are assembled to the housing 5 (described later specifically).

Here, a diameter Dh of the through hole 30 and an outer diameter D1 of the blade pressing spring 6 at least satisfy the following formula.

$$Dh<D1$$

That is, the blade pressing spring 6 is always seated on the receiving portion 5*a* without being dropped from the receiving portion 5*a*.

<Assembling Tool>

In this embodiment, the blade pressing springs 6 and the blade assembly 10 are assembled to the housing 5 by using the above-described through holes 30 and an assembling tool 31 described later. First, with reference to FIG. 17, the assembling tool 31 will be described. FIG. 17 is a sectional view showing the assembling tool 31.

The assembling tool 31 is a tool for assembling the blade pressing springs 6 and the blade assembly 10 to the housing 5 and is constituted by including a base member 32, a slidable member 33, and a pressing spring 34.

The base member 32 is fixed to a base (not shown). The slidable member 33 is constituted by including guiding pins 33*a* and slidable portions 33*b*. The guiding pins 33*a* are provided at a plurality of positions corresponding to the through holes 30 provided in the housing 5. In this embodiment, each of the guiding pins 33*a* has a substantially cylindrical shape such that a cross section substantially perpendicular to an axial direction thereof has a substantially circular shape. Each of the slidable portions 33*b* is supported by the base member 32 so as to be slidable into a slide hole 32*a* provided in the base member 32. The assembling tool 31 is disposed in a direction such that a side of a slidable member seating portion 33*d* which is a free end (free end-side end portion when the guiding pin 33*a* is inserted into the through hole 30) of the guiding pin 33*a* is an upper side of the direction of gravitation and the base member 32 side is a lower side of the direction of gravitation.

Between the slidable member 33 and the base member 32, the pressing spring 34 is provided. The pressing spring 34 is constituted by the compression coil spring, and one end portion thereof with respect to a coil center axis direction (expansion-contraction direction) thereof is seated on the slidable member seating portion 33*d* and the other end portion thereof with respect to the coil center axis direction is seated on a base member seating portion 32*b*. The slidable member 33 receives a predetermined force in a direction (toward the upper side of the direction of gravitation) away from the base member 32 by the pressing action of the pressing spring 34, and is rest in a position where the predetermined force is balanced with a self-weight of the slidable member 33.

<Assembling Method Using Assembling Tool>

Next, with reference to parts (a) and (b) of FIG. 18, a method of assembling the blade pressing springs 6 and the blade assembly 10 to the housing 5 by using the assembling tool 31 will be described. Parts (a) and (b) of FIG. 18 are sectional views each for illustrating an assembling procedure of the blade pressing springs 6 and the blade assembly 10. Part (a) of FIG. 18 is the sectional view showing a state in which the housing 5 and the blade pressing springs 6 are assembled with the assembling tool 31, and part (b) of FIG. 18 is the sectional view showing a state in which the blade assembly 10 is further assembled with the assembling tool 31. The assembling of the blade pressing springs 6 and the blade assembly 10 by using the assembling tool 31 is carried out by the following procedure.

1. Set Housing 5 on Assembling Tool 31

First, as shown in part (a) of FIG. 18, the housing 5 is set on the assembling tool 31. The housing 5 is positioned by inserting the guiding pin 33*a* provided on the assembling tool 31 into the above-described through hole 30. That is, the diameter Dp (see FIG. 17) of the guiding pin 33*a* and the diameter Dh (see FIG. 16) of the through hole 30 satisfy at least the following formula.

$$Dp<Dh$$

Here, the guiding pins 33*a* are provided in the same number as the through holes 30 provided in the plurality of the receiving portions 5*a* of the housing 5, and the guiding pins 33*a* are inserted into all the through holes 30. Further, when the housing 5 is set on the assembling tool 31, an outer side surface 5*c* of the housing 5 and the contact portion 35 of the slidable member 33 abut against each other by contact with each other, so that the position of the housing 5 is determined.

Then, the slidable member 33 receives the self-weight of the housing 5 and lowers until a position where a reaction force of the pressing spring 34 and the self-weights of the slidable member 33 and the housing 5 are balanced with each other, and then comes to a standstill.

2. Sheet Blade Pressing Spring 6 on Assembling Tool 31

Next, as shown in part (a) of FIG. 18, in a state in which the housing 5 is set on the assembling tool 31, the blade pressing spring 6 is mounted in the substantially cylindrical groove portion 5*b* provided in the housing 5. Here, an inner diameter D2 (see FIG. 16) of the blade pressing spring 6 and the diameter Dp of the guiding pin 33*a* satisfy the following formula.

$$D2>Dp$$

For that reason, the guiding pin 33*a* passes through an inside of the inner diameter portion of the blade pressing spring 6 when the blade pressing spring 6 is assembled with the housing 5, and holds the blade pressing spring 6. Thus, the guiding pin 33*a* holds an inner peripheral (surface) portion of the blade pressing spring 6, so that it is possible to prevent falling of the blade pressing spring 6 by unintentional vibration or contact with an operator.

Further, in this embodiment, a length Lg of the guiding pin 33*a* is set as follows. That is, in a state in which the housing 5 and the blade pressing spring 6 are assembled with the housing 5, the length Lg is set at a length such that a guiding pin free end 33*c* projects from an end portion 6*a* of the blade pressing spring 6 toward the blade assembly side in a free length state of the blade pressing spring 6. By this, when the blade assembly 10 is assembled as described later, buckling of the blade pressing spring 6 (particularly, the compression coil spring comprised of the single coil portion) can be prevented.

3. Assemble Blade Assembly 10

Next, after the blade pressing spring 6 is assembled on the assembling tool 31, the blade assembly 10 is assembled as shown in part (a) of FIG. 18. The blade assembly 10 is moved in an arrow S direction in the figure, so that assembling is carried out. Here, as described above, the guiding pin free end 33*c* projects toward the blade assembly side more than the end portion 6*a* of the blade pressing spring 6 in the free length state. For this reason, when the blade assembly 10 is assembled, the blade assembly 10 first contacts the guiding pin free end 33*c* (the first contact portion 45 of the swing plate 4 in the case of the embodiment 1). By this, it becomes possible to prevent the buckling of the blade pressing spring 6, as shown in FIG. 19, capable of generating by contact of the end portion 6*a* of the blade pressing spring 6 (particularly, the compression coil spring comprised of the single coil portion) with the blade assembly 10 earlier than the guiding pin free end 33*c*. Further, it becomes possible to prevent a deviation in contact position of the blade pressing spring 6 with the blade assembly 10. Incidentally, FIG. 19 is a schematic sectional view (cross section passing through the coil center axis) showing a state in which falling of the blade pressing spring 6 occurred when the blade assembly 10 is assembled.

Further, as shown in part (b) of FIG. 18, in the state in which the blade assembly 10 contacts the guiding pin free end 33*c*, the blade assembly 10 is further moved in the arrow S direction in the figure. Then, the slidable member 33 receives the pressing force from the blade assembly 10 and is retracted in the arrow S direction in the figure. Then, in a state in which movement of the blade assembly 10 to a predetermined position is completed, the swing shaft 8 is inserted into the supporting hole 53 similarly as described in the embodiment 1 with reference to FIG. 9, so that the assembling of the blade assembly 10 is completed. Thereafter, the housing 5 can be removed from the assembling tool 31.

By the above-described constitution, when the blade pressing spring 6 is assembled to the housing 5, the falling of the blade pressing spring 6 due to unintended vibration and contact by the operator can be prevented. Further, during the assembling of the blade assembly 10, it is possible to assemble the blade assembly 10 in a state in which the guiding pin 33*a* holds an entire region of the blade pressing spring 6 with respect to the longitudinal direction (Lg direction in part (a) of FIG. 18). For that reason, it becomes possible to suppress a fluctuation in pressing point due to the buckling of the blade pressing spring 6 and a deviation of the contact position of the blade pressing spring 6. As a result, it becomes possible to provide the cleaning device 106 capable of applying stable contact pressure of the cleaning blade 1 with a small fluctuation in contact pressure of the cleaning blade 1 due to an assembling error.

Incidentally, there is no need that the through hole 30 and the guiding pin 33*a* have a circular cross section. The through hole 30 and the guiding pin 33*a* may only be required to have a shape such that the guiding pin 33*a* is capable of being inserted into the through hole 30 and is also capable of being inserted into the inside of the inner diameter portion of the blade pressing spring 6 and such that the inner peripheral portion of the blade pressing spring 6 is capable of being supported by the guiding pin 33*a*. For example, an effect similar to the effect of this embodiment even when the through hole 30 and the guiding pin 33*a* having a rectangular shape in cross section are used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-155023 filed on Sep. 15, 2020, which is hereby incorporated by reference herein in its entirety.

What is claimed is:

1. A cleaning device comprising:

a cleaning blade configured to remove toner from a surface of a rotatable member in contact with the surface of the rotatable member;

a supporting portion supporting said cleaning blade;

a housing configured to swingably hold said supporting portion; and a blade pressing spring provided between said supporting portion and said housing and formed of a single wire material and pressing said supporting portion so as to press said cleaning blade against said rotatable member, wherein said blade pressing spring includes:

a first coil portion provided between said supporting portion and said housing so as to be capable of being expanded and contracted;

a second coil portion provided between said supporting portion and said housing so as to be capable of being expanded and contracted; and a connecting portion connecting said first coil portion and said second coil portion, and wherein said first coil portion and said second coil portion are disposed side by side with respect to a direction crossing a center axis direction of said first coil portion.

2. A cleaning device according to claim 1, wherein said connecting portion connects one end side of said first coil portion and one end side of said second coil portion which are on the same side with respect to the center axis direction of said first coil portion.

3. A cleaning device according to claim 1, wherein said connecting portion connects said first coil portion and said second coil portion so that an end portion of said first coil portion on a supporting portion side and an end portion of said second coil portion on the supporting portion side are connected to each other.

4. A cleaning device according to claim 1, wherein said first coil portion and said second coil portion are disposed at positions different from each other with respect to the direction crossing the center axis direction of said first coil portion, and a center axis of said first coil portion and a center axis of said second coil portion are substantially parallel to each other.

5. A cleaning device according to claim 1, wherein said connecting portion includes a crossing portion crossing a plane passing through a center axis of said first coil portion and a center axis of said second coil portion.

6. A cleaning device according to claim 1, wherein when said connecting portion is viewed substantially parallel to a center axis of said first coil portion, said connecting portion has a shape which is substantially the same shape in a case that said connecting portion is rotated 180 degrees with respect to an axis which passes through a midpoint of a line segment connecting the center axis of said first coil portion and a center axis of said second coil portion and which is substantially parallel to the center axis of said first coil portion.

7. A cleaning device according to claim 1, wherein a winding direction of said first coil portion and a winding direction of said second coil portion are the same.

8. A cleaning device according to claim 1, wherein said connecting portion has a shape extending along a line segment connecting a tangential line of said first coil portion and a tangential line of said second coil portion.

9. A cleaning device according to claim 1, wherein said housing includes a first accommodating portion accommodating at least a part of said first coil portion and a second accommodating portion accommodating at least a part of said second coil portion.

10. A cleaning device according to claim 9, wherein a preventing portion is provided between said first coil portion and said second coil portion and is configured to prevent said first coil portion and said second coil portion from being accommodated in said first accommodating portion and said second accommodating portion, respectively, by abutting on said connecting portion in a case that said blade pressing spring is assembled with said housing so that said connecting portion faces toward a housing side.

11. A cleaning device according to claim 10, wherein said preventing portion is disposed between said first coil portion and said second coil portion, and a height of said preventing portion is lower than heights of edges of said first coil portion and said second coil portion.

12. A cleaning device according to claim 9, wherein said first coil portion and said second coil portion are accommodated in said first accommodating portion and said second accommodating portion, respectively, so as to prevent rotation of said first coil portion about a center axis thereof.

13. A cleaning device according to claim 9, wherein each of bottoms of said first accommodating portion and said second accommodating portion is provided with a through hole, and a seating region where said blade pressing spring is seated is provided around the through hole.

14. A cleaning device according to claim 1, further comprising a second blade pressing spring provided between said supporting portion and said housing and formed of a single wire material and provided on the same side as said blade pressing spring with respect to a longitudinal direction of said cleaning blade, wherein said second blade pressing spring includes:

a third coil portion provided between said supporting portion and said housing so as to be capable of being expanded and contracted;

a fourth coil portion provided adjacent to said third coil portion with respect to a direction crossing a center axis direction of said third coil portion and disposed between said supporting portion and said housing so as to be capable of being expanded and contracted; and a second connecting portion connecting one end side of said third coil portion and one end side of said fourth coil portion with respect to the center axis direction of said third coil portion.

15. A cleaning device according to claim 14, wherein said blade pressing spring and said second blade pressing spring are in non-connection to each other.

* * * * *